US005587281A

United States Patent [19]

Saitou et al.

[11] Patent Number: 5,587,281

[45] Date of Patent: Dec. 24, 1996

[54] METHOD FOR PRODUCING SILVER HALIDE GRAIN AND SILVER HALIDE EMULSION USING THE GRAIN

[75] Inventors: Mitsuo Saitou; Junichi Yamanouchi; Yoichi Hosoya, all of Kanagawa, Japan

[73] Assignee: Fuji Photo Film Co., Ltd., Kanagawa, Japan

[21] Appl. No.: 501,959

[22] Filed: Jul. 13, 1995

[30] Foreign Application Priority Data

Jul. 14, 1994 [JP] Japan ..... 6-184128

[51] Int. Cl.[6] ..... G03C 1/047; G03C 1/043; G03C 1/035

[52] U.S. Cl. ..... 430/567; 430/569; 430/677; 430/628; 430/637; 430/642

[58] Field of Search ..... 430/627, 628, 430/637, 642, 567, 569

[56] References Cited

U.S. PATENT DOCUMENTS

| | | | |
|---|---|---|---|
| 4,713,320 | 12/1987 | Maskasky | 430/567 |
| 4,713,323 | 12/1987 | Maskasky | 430/567 |
| 5,236,817 | 8/1993 | Kim et al. | 430/637 |
| 5,252,442 | 10/1993 | Dickerson et al. | 430/567 |
| 5,252,452 | 10/1993 | Chang et al. | 430/567 |
| 5,439,787 | 8/1995 | Yamanouchi et al. | 430/569 |

FOREIGN PATENT DOCUMENTS

| | | | |
|---|---|---|---|
| 0514742A1 | 5/1992 | European Pat. Off. | G03C 1/07 |

*Primary Examiner*—Mark F. Huff

*Attorney, Agent, or Firm*—Sughrue, Mion, Zinn, Macpeak & Seas

[57] ABSTRACT

Disclosed is a method for producing silver halide grains containing tabular grains having a thickness of from 0.02 to 0.3 μm and an aspect ratio (diameter/thickness) of from 2 to 50 at a proportion of from 75 to 100% of the total projected area of silver halide grains, which comprises at least nucleation, ripening and growing steps in a dispersion medium solution consisting of water and a dispersion medium, wherein gelatin having the following characteristics (a) occupies from 30 to 100 wt % of said dispersion medium used in said growing step:

characteristics (a)

the relation between the number percentage of a chemically modified —$NH_2$ group in the gelatin and the methionine content of the gelatin is in the region $a_1$ depicted in FIG. 1.

Also disclosed is a silver halide emulsion comprising at least a dispersion medium and silver halide grains produced by the above-described method.

9 Claims, 5 Drawing Sheets

METHOD FOR PRODUCING SILVER HALIDE GRAIN AND SILVER HALIDE EMULSION USING THE GRAIN

FIELD OF THE INVENTION

The present invention relates to a method for producing a silver halide grain (hereinafter referred to as "AgX") useful in the field of photography and a silver halide emulsion containing the grain.

BACKGROUND OF THE INVENTION

The use of a support having coated thereon an AgX emulsion containing tabular grains having a large aspect ratio (diameter/thickness) in a photographic material is advantageous in the following points. For example, sharpness is improved by capability of reduction in the film thickness, a spectral sensitizing dye can be adsorbed in a large quantity by a great surface/volume ratio, a light absorptivity is improved, development processing is expedited by a great surface/volume ratio and granularity is improved by levelling of an image. Accordingly, tabular grains have hitherto been used so often in many photographic materials. However, when the tabular grain is produced by conventional methods, the following defects are involved. Non-tabular grains mingle together and the grain size distribution is broad. In other words, the grains obtained are polydispersed in view of the grain form (i.e., the grain shape) and the size distribution. As a result, if the grains are subjected to chemical sensitization or spectral sensitization, it fails to effect optimal chemical sensitization or spectral sensitization on all grains and thus, a multilayer effect is diminished.

In order to overcome this disadvantage, various investigations have been made from a technical viewpoint. The present inventors have made investigations on optimal conditions for three respective steps, namely, nucleation, ripening and growing steps constituting the production procedure of a tabular grain containing parallel twin planes. More specifically, the matters investigated are such that in the nucleation step, the twin plane formation probability is controlled not too high but not too low. In the ripening step, using the selective growth property of tabular grains at a low supersaturation degree, tabular grains are allowed to remain and other non-tabular grains vanish. And, in the growing step, by selecting the concentration or super-saturation degree of halogen ions (hereinafter referred to as "$X^-$") so as to achieve a selective growth property of a tabular grain and a diffusion rate-determining growth property at edge portions, the growth is advanced without broadening the size distribution. The following literatures describe thereon in detail and can be referred to.

With respect to the details of a tabular grain having a $Cl^-$ content of 50 mol % or more, U.S. Pat. Nos. 5,176,992, 5,061,617, 4,400,463, 5,185,239, 5,183,732, 5,178,998 and 5,178,997, JP-A-4-283742 (the term "JP-A" as used herein means an "unexamined published Japanese patent application") and JP-A-4-161947 may be referred to, and with respect to grains having a high $Br^-$ content, JP-A-63-151618, JP-A-63-11928, JP-A-2-28638, JP-A-1-131541, JP-A-2-838, JP-A-2-298935 and JP-A-3-121445 may be referred to.

On the other hand, in the case of a tabular grain having {100} faces as main planes, if the grain is produced by conventional methods, similar problems are also caused. For the betterment thereof, the grain production formulation is parted into three steps, namely, nucleation, ripening and growing steps, and improved methods for respective steps have been proposed. JP-A-5-281640, JP-A-5-313273, U.S. Pat. Nos. 4,063,951, 4,386,156, 4,946,772, 5,264,337 and 5,275,930 and European Patent 0534395A1 describe thereon in detail and can be referred to.

As a result of these investigations, monodispersibility is outstandingly improved from the aspects of the grain form and the grain size distribution. However, a problem is still in need of overcoming, that is, as the thickness of a tabular grain is reduced more and more, the resulting grain size distribution is broadened. Also, a method for producing a tabular grain having a lower fog density and further excellent sensitivity and granularity has been demanded. To cope with this demand, an attempt has been proposed to improve properties of the grain by changing the dispersion medium at the time of grain formation. For example, in Kelly, *Journal of Photographic Science*, Vol. 6, 16–22 (1958), an AgBrI tabular grain is formed by adding an aqueous $AgNO_3$ solution to an aqueous solution containing oxidation-processed gelatin oxidized under various conditions and $X^-$. Sheppard or many other authors have written on the use of oxidation-processed gelatin oxidized by $H_2O_2$ or the like. For the details thereon, British Patent 245,456, French Patent 768,015 and *Gelatin in Photography-Monographs on the Theory of Photography from the Research Laboratory of the Eastman Kodak Co.*, No. 3, D. Van Nostrand Co., New York may be referred to. Also, it is confirmed that a methionine group is converted into methionine sulfoxide upon oxidation and *Journal of Photographic Science*, Vol. 16, 68–69 (1968) describes thereon.

Recently, a tabular grain having a thickness of 0.2 μm or less has been produced in an oxidation-processed gelatin dispersion medium solution having a methionine content of less than 30 μmol/g, as described, for example, in JP-A-62-157024. When a tabular grain is produced using the above-described gelatin, a tabular grain thinner than the grain obtained using non-oxidized gelatin is formed at all temperatures range of 76° C. or less. However, as the grain thickness is reduced, the size distribution of produced grains is still broadened. European Patent 514742A discloses a method for overcoming the above-described defect by forming an AgBr tabular grain having {111} faces as main planes in the presence of oxidized gelatin described above and a polyalkylene compound. However, the tabular grain obtained has main planes in the irregularly distorted equilateral hexagonal form and also fails to have sensitivity, granularity and fog density on a satisfactory level.

SUMMARY OF THE INVENTION

An object of the present invention is to provide a method for producing an AgX tabular grain having low fog density, excellent sensitivity and excellent granularity.

Another object of the present invention is to provide a silver halide emulsion containing the above-described grain.

The objects of the present invention have been achieved by:

(1) a method for producing silver halide grains containing tabular grains having a thickness of from 0.02 to 0.3 μm and an aspect ratio (diameter/thickness) of from 2 to 50 at a proportion of from 75 to 100% of the total projected area of silver halide grains, which comprises at least nucleation, ripening and growing steps in a dispersion medium solution consisting of water and a dispersion medium, wherein gelatin having the following characteristics (a) occupies from 30 to 100 wt % of the dispersion medium used in the growing step:

characteristics (a)

the relation between the number percentage of a chemically modified $—NH_2$ group in the gelatin and the methionine content of the gelatin is in the region $a_1$ depicted in FIG. 1;

(2) preferably, the method for producing silver halide grains as described in item (1) above, wherein the dispersion medium solution is a polymer having a repeating unit of polyalkylene oxide and contains HPAO (represented by formula (1)-a) or (1)-b)) or PEOD (represented by any one of formulae (2)-a) to (2)-f)) having a molecular weight of from 500 to $10^6$ in an amount of 0.001 g/l or more:

HO-LPAOU-HPEOU-LPAOU-H (1)-a)

HO-HPEOU-LPAOU-HPEOU-H (1)-b)

wherein HPEOU represents $$\left(\begin{array}{c} R^0 \\ | \\ CH-CH_2O \end{array}\right)_m$$

and LPAOU represents $-(R—O)_n-$ wherein $R^0$ represents H or a hydrocarbon (e.g., $—CH_2OH$, $—C_2H_5OH$ and $—CH_2—O—CH_3$) containing at least one polar group and having from 1 to 10 carbon atoms (preferably H), R represents an alkylene group having from 3 to 10 carbon atoms and n and m each represents an average number of the repeating unit of 4 or more satisfying the requirement for the molecular weight;

LPU-HPEOU-H (2)-a)

LPU-HPEOU-LPU' (2)-b)

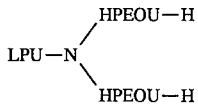

(2)-c)

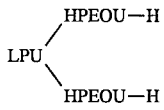

(2)-d)

HPEOU-H

LPU-HPEOU-H (2)-e)

HPEOU-H

HO-HPEOU-LPU-HPEOU-H (2)-f)

wherein LPU represents a lipophilic group other than an HO-HPEOU- group or an HO-LPAOU- group and represents a substituted or unsubstituted alkyl group, a substituted or unsubstituted alkenyl group, a substituted or unsubstituted aryl group, a substituted or unsubstituted heterocyclic group, a substituted or unsubstituted alkoxy group, a substituted or unsubstituted aryloxy group, a substituted or unsubstituted acyl group, a substituted or unsubstituted acylamino group, a substituted or unsubstituted alkylthio group, a substituted or unsubstituted arylthio group, a substituted or unsubstituted alkoxycarbonyl group, a substituted or unsubstituted aryloxycarbonyl group or a substituted or unsubstituted alicyclic group and HPEOU and LPAOU each has the same meaning as in formula (1) (the above substituted groups may be preferably substituted with a substituent group selected from the group consisting of $C_dH_{2d+1}$— and $C_dH_{2d+1}CO$— (d=an integer of from 1 to 12); LPU' represents a hydrogen atom or an alkyl group having 1 to 20 carbon atoms;

(3) preferably, the method for producing silver halide grains as described in item (1) above, wherein the dispersion medium solution contains at least one polymer containing 1 wt % or more of a repeating unit of the monomer represented by formula (3) in an amount of 0.01 g/l or more and the polymer has a molecular weight of from 500 to $10^6$:

$$CH_2=\overset{\overset{R^1}{|}}{C}-L\left(R^3-O\right)_n R^2 \quad (3)$$

wherein $R^1$ represents H or a lower alkyl group having 1 to 4 carbon atoms, $R^2$ represents a monovalent substituent having 1 to 20 carbon atoms, $R^3$ represents an alkylene group having from 3 to 10 carbon atoms, L represents a divalent linking group and n represents an average number of the repeating unit of from 4 to 600;

(4) preferably, the method for producing silver halide grains as described in item (1) above, wherein the dispersion medium solution contains 0.01 g/l or more of a copolymer containing at least two kinds of monomers represented by formula (3) and formula (4) each in an amount of 1 wt % or more and the copolymer has a molecular weight of from 500 to $10^6$:

$$CH_2=\overset{\overset{R^1}{|}}{C}-L\left(R^3-O\right)_n R^2 \quad (3)$$

wherein $R^1$ represents H or a lower alkyl group having 1 to 4 carbon atoms, $R^2$ represents a monovalent substituent having 1 to 20 carbon atoms, $R^3$ represents an alkylene group having from 3 to 10 carbon atoms, L represents a divalent linking group and n represents an average number of the repeating unit of from 4 to 600;

$$CH_2=C(R^4)—L'—(CH_2CH_2O)_m—R^5 \quad (4)$$

wherein $R^4$ represents H or a lower alkyl group having 1 to 4 carbon atoms, $R^5$ represents a monovalent substituent having 1 to 20 carbon atoms, L' represents a divalent linking group and m represents an average number of the repeating unit of from 4 to 600;

(5) preferably, the method for producing silver halide grains as described in item (1) above, wherein the dispersion medium solution contains at least one polymer containing 1 wt % or more of the repeating unit represented by formula (5) and at least one polymer containing 1 wt % or more of the repeating unit represented by formula (6) respectively in an amount of 0.01 g/l or more and each the polymer has a molecular weight of from 500 to $10^6$:

$$—(R—O)_n— \quad (5)$$

$$—(CH_2CH_2O)_m— \quad (6)$$

wherein R represents an alkylene group having from 3 to 10 carbon atoms and n and m each represents an average number of the repeating unit of 4 or more satisfying the requirement for the molecular weight;

(6) preferably, the method for producing silver halide grains as described in item (5) above, wherein the polymer having the repeating unit represented by formula (5) is at least one polymer selected from polymers containing a vinyl polymer having a monomer represented by formula (7)-(a) as a constituent component and a polyurethane represented by formula (7)-(b) and the polymer having the repeating unit represented by formula (6) is at least one polymer selected from polymers containing a vinyl polymer having a monomer represented by formula (7)-(c) as a constituent component, a polyurethane represented by formula (7)-(d) and a substituted or unsubstituted polyethylene glycol:

$$CH_2=C(R^1)-L-(R^3-O)_n-R^2 \quad (7)\text{-a)}$$

$$+O-(R-O)_{n]x}-+O-R^{11}-O]_y+CONH-R^{12}-NHCO]_z- \quad (7)\text{-b)}$$

$$CH_2=C(R^4)-L'-(CH_2CH_2O)_m-R^5 \quad (7)\text{-c)}$$

$$+O+CH_2CH_2O)_{m]x}-+O-R^{13}-O]_y+CONH-R^{14}-NHCO]_z- \quad (7)\text{-d)}$$

wherein n and m each represents an average number of the repeating unit of from 4 to 600, $R^1$ and $R^4$ each represents H or a lower alkyl group having from 1 to 4 carbon atoms, $R^2$ and $R^5$ each represents H or a monovalent substituent having from 1 to 20 carbon atoms, L and L' each represents a divalent linking group, $R^{11}$, $R^{12}$, $R^{13}$ and $R^{14}$ each represents a divalent linking group and specifically, an alkylene group having from 1 to 20 carbon atoms, a phenylene group having from 6 to 20 carbon atoms or an aralkylene group having from 7 to 20 carbon atoms, x, y, z, x', y' and z' each represents a weight percentage of each component where x and x' each is from 1 to 70, y and y' each is from 1 to 70 and z and z' each is from 20 to 70, provided that x+y+z=100 and x'+y'+z'=100, and R represents an alkylene group having from 3 to 10 carbon atoms;

(7) preferably, the method for producing silver halide grains as described in items (1) to (6) above, wherein the tabular grains has {100} faces or {111} faces as main planes and the grain has a coefficient of variation in the diameter distribution (standard deviation/average diameter) of from 0 to 0.3.

Further, the objects of the present invention have been achieved by:

(8) a silver halide emulsion comprising at least a dispersion medium and silver halide grains, wherein tabular grains having a thickness of from 0.02 to 0.3 μm and an aspect ratio (diameter/thickness) of from 2 to 50 occupy from 75 to 100% of the total projected area of the silver halide grains, the grain has a coefficient of variation in the diameter distribution (standard deviation/average diameter) of from 0 to 0.3 and the dispersion medium contains (gelatin with the relation between the number percentage of a chemically modified —$NH_2$ group and the methionine content being in the region $a_1$ in FIG. 1) in an amount of from 30 to 100 wt %.

Other preferred embodiments of the present invention are described below:

(9) a silver halide emulsion comprising silver halide grains having adsorbed thereon at least a spectral sensitizing dye and a dispersion medium, wherein tabular grains having an aspect ratio of from 2 to 50 and a thickness of from 0.02 to 0.3 μm occupy from 75 to 100% of the projected area of the silver halide grains, the coefficient of variation in the diameter distribution thereof is from 0 to 0.3 and the coefficient of variation in the adsorbed surface coverage by a spectral sensitizing dye is from 0 to 0.3;

(10) a silver halide emulsion as described in item (9) above, wherein the tabular grain is at least subjected to selenium sensitization in an amount of $10^{-7}$ mol/mol-Ag or more, the Se content in the tabular grain is proportional to the surface area of the tabular grain and the coefficient of variation in the distribution in the proportional constant of grains is from 0 to 0.3; and

(11) a silver halide emulsion as described in items (9) and (10), wherein the tabular grain is at least subjected to gold sensitization in an amount of $10^{-7}$ mol/mol-Ag or more, the gold content in the tabular grain is proportional to the surface area of the tabular grain and the coefficient of variation in the distribution in the proportional constant of grains is from 0 to 0.3.

Figure 1:
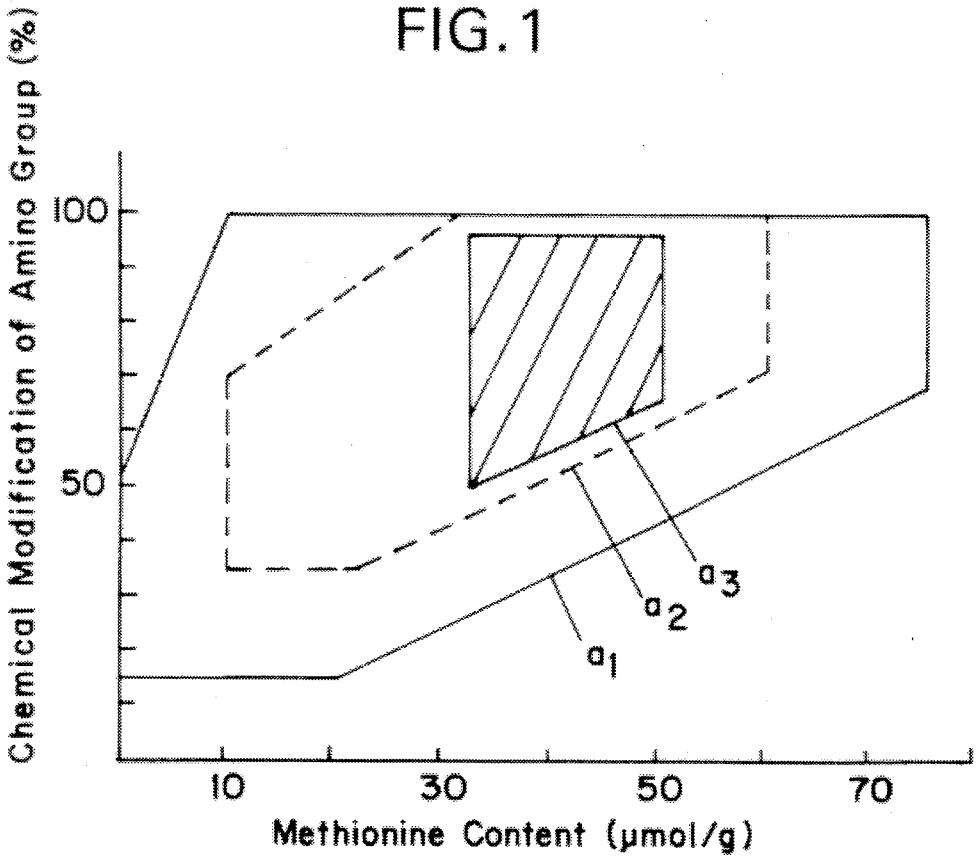
FIG. 1 shows a preferred combination range for the methionine content (μmol/g) vs. chemical modification (%) of the amino group of gelatin used in the present invention.

The upper limit line in the region $a_1$ of FIG. 1 shows a chemical modification (ratio) of 100% and the upper limit line in the region $a_3$ of FIG. 1 shows a chemical modification (ratio) of 97%.

Figure 2:
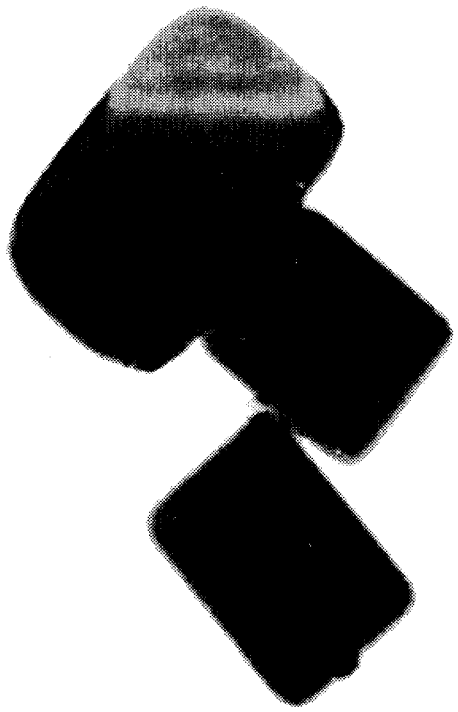

FIG. 2 shows an example of the crystal structure (dislocation line structure) of a (100) tabular grain.

Figure 3A:
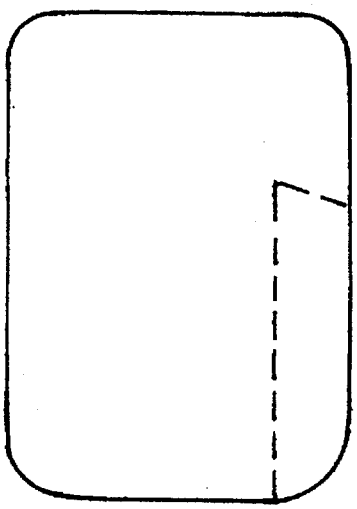
Figure 3B:
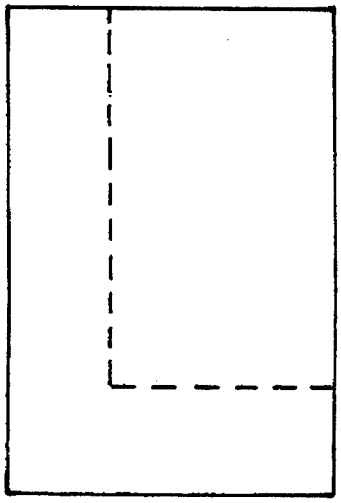

FIG. 3(*a*)–3(*b*) are a schematic view showing the structure of dislocation lines.

Figure 4:
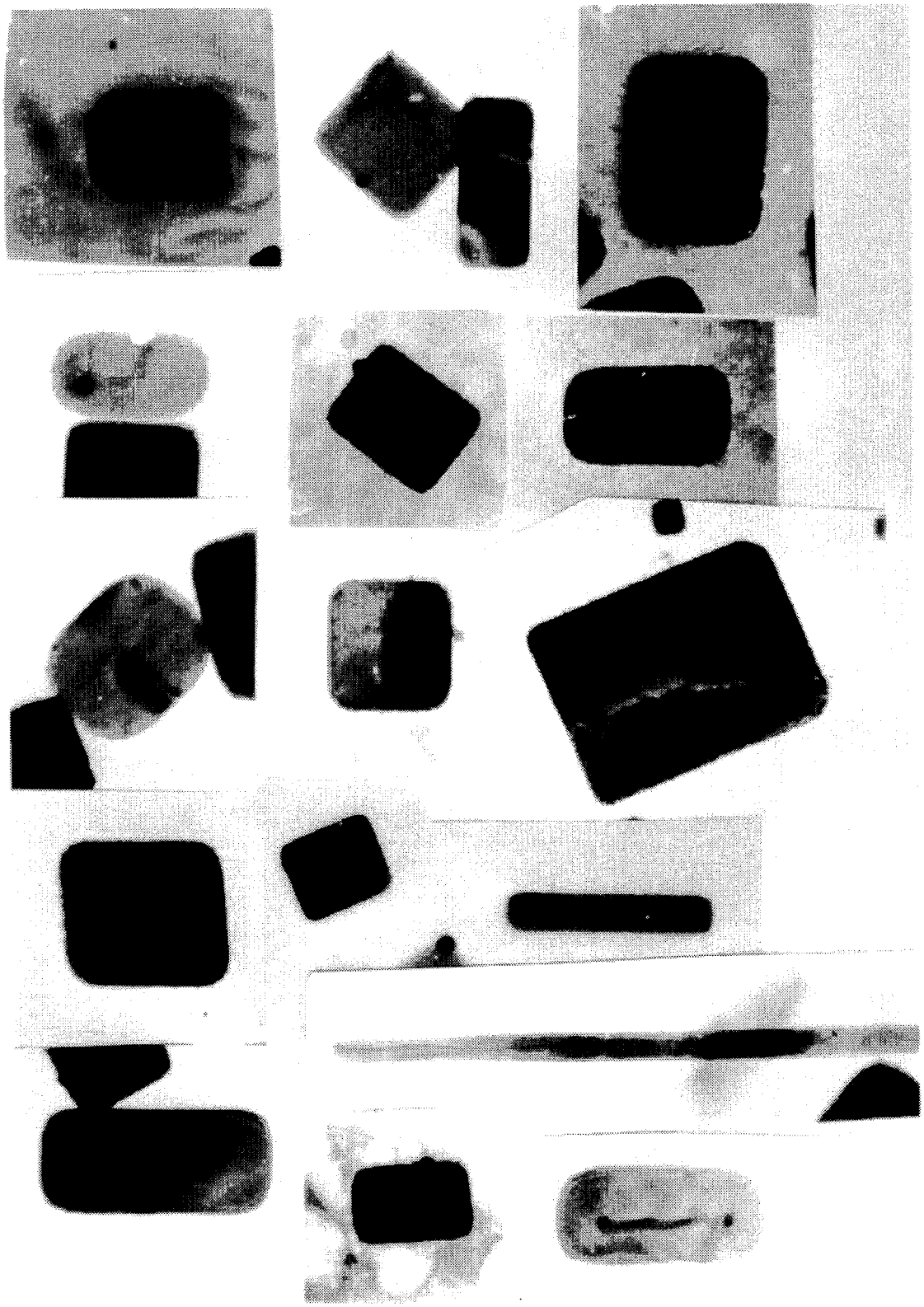

FIG. 4 shows an example of the crystal structure (dislocation line structure) of various type grains observed.

Figure 5:
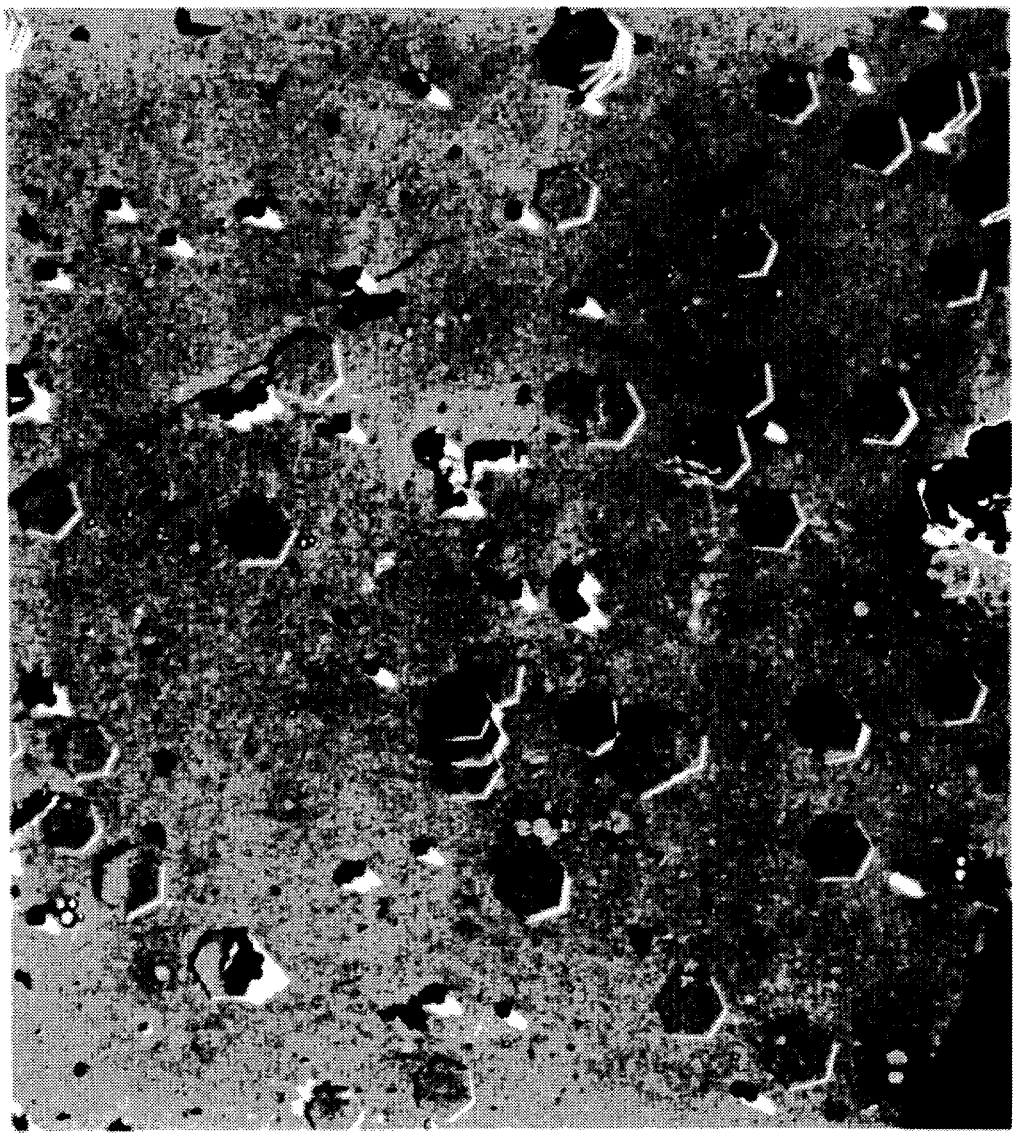

FIG. 5 shows the crystal structure of a tabular grain obtained in Example 3.

Figure 6:
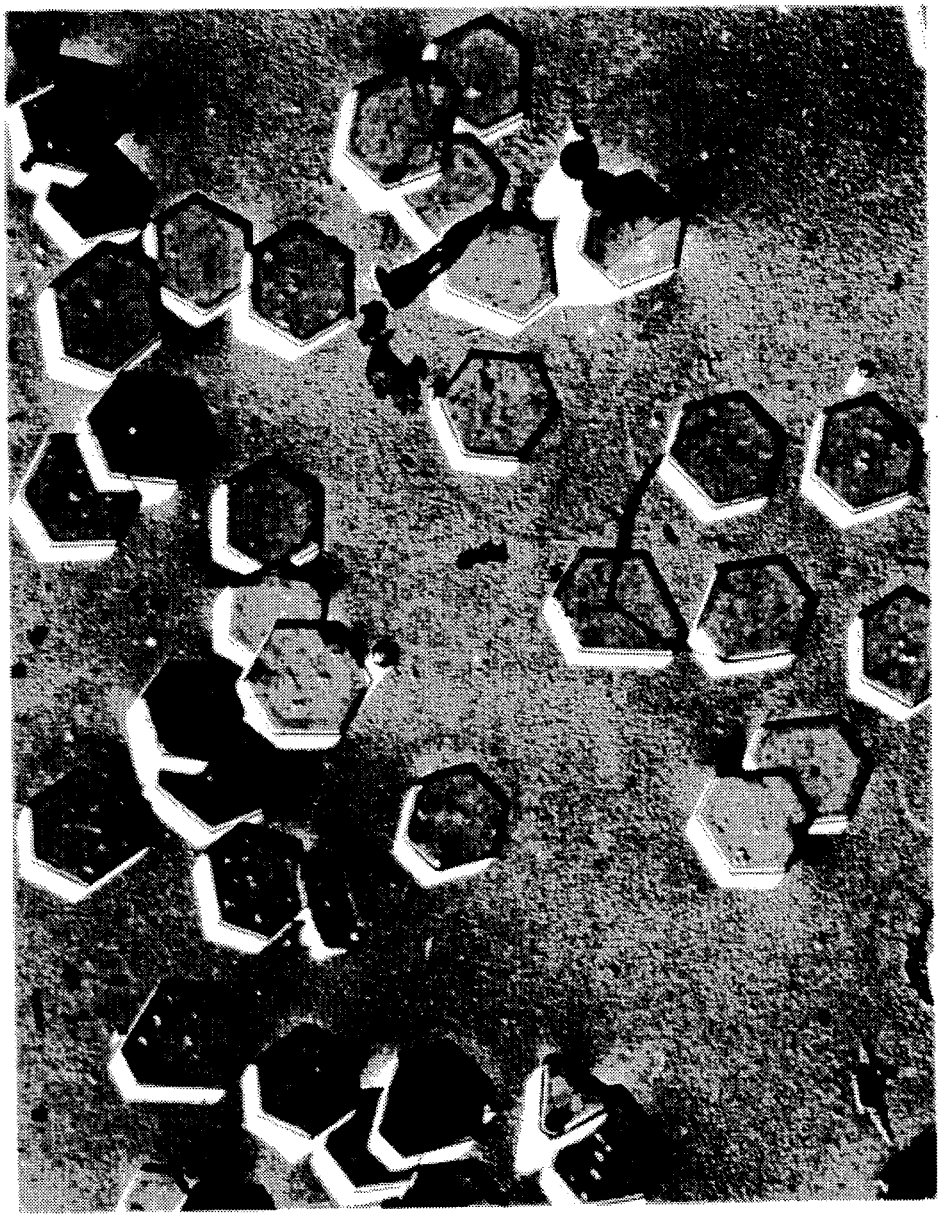

FIG. 6 shows the crystal structure of a tabular grain obtained in Comparative Example 1.

DETAILED DESCRIPTION OF THE INVENTION

The present invention is described below in greater detail.

A. Tabular Grain

The tabular grain includes a tabular grain having {100} faces as main planes (hereinafter referred to as "(100) tabular grain") and a tabular grain having {111} faces as main planes (hereinafter referred to as "(111) tabular grain").

The tabular grain has a thickness of generally 0.02 μm to 0.3 μm, preferably from 0.02 to 0.15 μm, more preferably from 0.03 to 0.10 μm and most preferably from 0.04 to 0.08 μm. The aspect ratio (diameter/thickness) thereof is generally from 2 to 50, preferably from 3 to 30. The coefficient of variation in the diameter distribution (standard deviation of distribution/average diameter, hereinafter referred to "C.V. value") thereof is generally from 0 to 0.3, preferably 0 to 0.2, more preferably from 0 to 0.1 and most preferably from 0 to 0.08. The term "diameter" as used herein means a diameter of a circle having an area equivalent to the projected area of a grain and the term "thickness" as used herein means a distance between two main planes of a tabular grain. The diameter of the grain is preferably 0.1 μm or more, more preferably from 0.2 to 10 μm. The tabular grain occupies generally from 75 to 100%, preferably from 90 to 100%, more preferably from 97 to 100% of the total projected area of AgX grains. The coefficient of variation in the thickness distribution (standard deviation of distribution/average thickness) of the tabular grain is preferably from 0 to 0.3, more preferably from 0 to 0.2, most preferably from 0 to 0.1.

The tabular grain is produced through at least nucleation→ripening→growing steps. The nucleus of the finally obtained tabular grain is formed substantially in the nucleation step. The term "substantially" as used herein means preferably from 75 to 100% by number, more preferably from 95 to 100% by number of nuclei.

In the case when the above-described modified gelatin is used at the nucleation and ripening steps, the reaction solution at their steps preferably has a pH higher than the isoelectric point of the modified gelatin, more preferably a pH of from (isoelectric point+0.2) to 10, most preferably a pH of from (isoelectric point+0.4) to 7. The amount of $AgNO_3$ added at the nucleation is preferably 1 g or more, more preferably from 1.8 g or more, most preferably from 3 to 30 g, per 1 l of the reaction solution.

The nucleation is preferably effected by a double jet addition method of an $Ag^+$ solution and an $X^-$ solution into the reaction solution or a plural and alternate single jet addition method of from 2 to 1,000 times.

Now, description is set forth below in sequence starting from a (100) tabular grain.

A-1. (100) Tabular Grain

1. Grain Structure

Tabular grains having {100} faces as main planes can be classified into the following six groups in terms of the shape:

(1) a grain in which the main planes are in the form of a right-angled parallelogram and the adjacent sides ratio (length of long side/length in short side) in one tabular grain is generally from 1 to 10, preferably from 1 to 3, more preferably from 1 to 2;

(2) a grain in which at least one, preferably from one to three, of four corners in the right-angled parallelogram is nonequivalently missing, more specifically, $a_1$ (=area in the greatest missing/area in the smallest missing) is from 2 to ∞ (i.e., infinity);

(3) a grain with four corners being equivalently missing, namely, a grain in which the above-described $a_1$ is less than 2;

(4) a grain in which generally from 5 to 100%, preferably from 20 to 100%, of the area in missing parts are (111) faces;

(5) a grain in which at least two sides facing with each other of four sides surrounding the main plane are outwardly protruded curves; and (6) a grain in which one or more, preferably from one to three, of four corners of the right-angled parallelogram has a defect in the form of a right-angled parallelogram.

2. Nucleation

The nucleus of the (100) tabular grain is formed by the following methods:

(1) a method where in a low protective colloidal solution, a silver salt solution and a halogen salt solution (hereinafter referred to as "$X^-$ salt solution") are added to form a nucleus (in one thinking, the crystal defect is formed by coagulation); and (2) a method for forming a tabular nucleus using unconformity in the lattice constant, which includes the following embodiments.

a) In one embodiment, a nucleus having generally one or more, preferably from one to four, most preferably from two to three, gap interface of the halogen composition is formed, more specifically, in ($AgX_1|AgX_2$) which is an embodiment resulting from forming an $AgX_1$ nucleus and then laminating an $AgX_2$ layer on the surface of the nucleus, $X_1$ and $X_2$ are different in the halogen composition by, in terms of the $Cl^-$ content, $Br^-$ content or $I^-$ content, generally from 10 to 100 mol %, preferably from 30 to 100 mol %, more preferably from 60 to 100 mol %, in other words, the halogen composition of the $X^-$ salt solution added at the nucleus formation is varied discontinuously at the gap interface according to the above-described rules. The gap interface can also be formed by adding an $X_2^-$ salt solution to the $AgX_1$ nucleus to cause halogen conversion. The tabular nucleus having two gap faces can be represented by ($AgX_1|AgX_2|AgX_3$).

b) In another embodiment, in order to accelerate formation of defects due to the lattice unconformity, the content of at least one or more ion species of sulfur, selenium tellurium, $SCN^-$, $SeCN^-$, $TeCN^-$, $CN^-$ and metal ions other than $Ag^+$, and complexes of the metal ions (examples of the ligand including $X^-$ ligand, $CN^-$ ligand, isocyano, nitrosyl, thionitrosyl, amine and hydroxyl) is differentiated between adjacent phases of the gap by preferably from 0.1 to 100 mol %, more preferably from 1 to 100 mol %, most preferably from 10 to 100 mol %. Representative examples of the metal ion other than $Ag^+$ include metal ions belonging to Group VIII of the Periodic Table and metal ions of Cu, Zn, Cd, In, Sn Au, Hg, Pb, Cr and Mn.

c) In still another embodiment, the defect is formed by the gap of only said impurity ion contents. With respect to specific examples of the compound for said impurity ions and details on the doping method into the AgX phase, *Research Disclosure*, Vol. 307, Item 307105 (November, 1989), U.S. Pat. Nos. 5,166,045, 4,933,272, 5,164,292, 5,132,203, 4,269,927, 4,847,191, 4,933,272, 4,981,781 and 5,024,931, JP-A-4-305644, JP-A-4-321024, JP-A-1-183647, JP-A-2-20853, JP-A-1-285941 and JP-A-3-118536 can be referred to.

In the present invention, the nucleation in the embodiment 2-(2) (preferably 2-(2)-a)) is preferably used and the halogen conversion method is more preferably used. A tabular grain is formed because of the presence of a defect which accelerates growth in the edge direction of the tabular grain. The defect is referred to in the present invention as a screw dislocation defect. If the above-described defect is formed in a large number in one grain, growth in the three dimensional direction is accelerated to produce a thick grain. When the defect formation probability is gradually increased from zero, tabular grains having a side ratio of from 1 to 2 are formed and from this, the grain is considered to have one screw dislocation defect having a growth acceleration vector steering for the [110] direction or from −25° to +25° of the direction. As the probability increases, the production number of the tabular grains increases, and if the probability is further increased, the population ratio of grains having a low aspect ratio increases. This is considered because two or more defects are formed in one grain and the grain also has a growth acceleration vector steering for the thickness direction. Accordingly, the probability may be increased within the range where the population ratio of thick grains are allowable.

The gap may be formed by forming a ($AgX_1|AgX_{12}|AgX_2$) nucleus as well as it is formed in the ($AgX_1|AgX_2$) composition. In this case, the $AgX_{12}$ is an interlayer having a middle halogen composition between $AgX_1$ and $AgX_2$. If the difference in the halogen composition between $AgX_1$ and $AgX_2$ is increased, the number of tabular grain nuclei increases but the number ratio of thick grain nuclei also increases. The insertion of an interlayer has an effect such that although the number of tabular grain nuclei produced increases, the production ratio of thick grain nuclei is inhibited. In this case, the halogen composition gap amount in ($AgX_1|AgX_{12}$) or in ($AgX_{12}|AgX_2$) is preferably from 10 to 90%, more preferably from 30 to 70% of the gap amount in ($AgX_1|AgX_2$). The number of the interlayer is preferably from 1 to 4, more preferably 1. In the embodiment where two or more gap faces are present, the interlayer can be provided on one or more gap face.

3. Ripening

Among nuclei formed at the nucleation, non-tabular grain nuclei are vanished at this ripening step preferably in an amount of from 30 to 100% by number, more preferably from 60 to 100% by number to increase the ratio of tabular grains in the projected area. More specifically, the AgX solubility of the reaction solution is raised to preferably 1.1 times or more, preferably from 1.5 to 30 times at the ripening. The solubility can be increased by the following methods: (1) the temperature is raised by preferably 5° C. or more, more preferably from 10° to 60° C.; (2) an $X^-$ salt or a silver salt is added; (3) an AgX solvent is added; and (4) two or more among the above methods (1) to (3) are used in combination. When the ratio ($Cl^-$ concentration/$X^-$ concentration) in the reaction solution is from 0.9 to 1.0, it is preferred that 30% or more of the non-tabular grain nuclei is vanished by raising the temperature and then the AgX solubility is increased to preferably 1.1 times or more, more preferably from 1.3 to 10 times, by adding a Cl_ salt to thereby vanish preferably from 80 to 100%, more preferably from 97 to 100% of the remaining non-tabular grain nuclei.

After the vanishing, the excess $Cl^-$ concentration can be lowered by adding an $AgNO_3$ solution to the solution or by desalting the solution in a conventionally known manner for desalting an emulsion. The addition rate of the $AgNO_3$ solution can be selected optimally and the solution is preferably added at a rate causing no generation of new nuclei.

In ripening the nuclei having formed thereon the halogen composition gap interface to vanish the non-tabular grain nuclei, hetero halogen ions accumulate in the tabular grain growing at the ripening. At this time, defects such as screw dislocation are integrated into the tabular grain and then, a growth acceleration defect having a growth vector component steering for the direction perpendicular to the main plane is integrated into the grain. As a result, the tabular grain is further thickened along the growth thereof. The thickening can be prevented by diluting the hetero halogen ions with the host halogen ions. More specifically, in the case when the (inner corelouter core) of the nucleus is ($AgX_1|AgX_2$), the hetero ions $X_2$ released at the ripening may be diluted by a method where the ripening is conducted while adding $Ag^+$ and $X^-$, a method where the nuclear structure is converted to ($AgX_1|AgX_2|AgX_1$), a method where fine grains having a grain diameter of from 0.01 to 0.15 μm and being high in the $X_1$ compositional ratio are added, or a combination of two or more of these methods. The number of screw dislocation defects newly formed at the time of vanishing non-tabular grain nuclei by the dilution is preferably from 0 to 0.3, more preferably from 0 to 0.2 of the number of existing defects.

A-2. (111) Tabular Grain

1. Grain Structure

The (111) tabular grain can be classified into the following four groups in terms of the shape of the main plane:

(1) A hexagonal tabular grain having main planes of which outline shape is substantially a hexagon. The term "substantially" as used herein means an embodiment where the maximum adjacent sides ratio in the hexagon [(length of longest side/length of shortest side) in one hexagon] is preferably from 1 to 2, more preferably from 1 to 1.5, most preferably from 1 to 1.2.

(2) A triangular tabular grain having main planes of which outline shape is substantially a triangle. The term "substantially" as used herein means an embodiment where the adjacent sides ratio is larger than 2.

(3) A tabular grain in the above (1) or (2) of which corners are rounded. The tabular grain in this embodiment includes a circular tabular grain having a ratio ($b_1$) at the linear part in the outline sides of from 0 to 0.5 and a grain satisfying the condition of $0.5<b_1\leqq 1.0$, wherein $b_1$ represents the ratio of the length at the linear part in the outline sides to the length between intersections formed by extending the sides at the linear part.

(4) A grain of (1), (2) or (3) above where the ratio [area of {111} faces in the edge faces/total area of the edge faces] is from 0 to 1.0, where the ratio [area of {100} faces in the edge faces/total area of the edge faces] is from 0 to 1.0, or where the ratio [area of {111} faces in the edge faces/area of {100} faces in the edge planes] is from 0.01 to 100.

In the embodiment of the above-described hexagonal tabular grain having six sides or the triangular tabular grain, $b_2$ (=length of longest side/length of shortest length) of alternate three sides is preferably from 1 to 1.3, more preferably from 1 to 1.2, most preferably from 1 to 1.1. The total projected area of the grains preferably occupies preferably 80% or more, more preferably 90% or more, most preferably from 97 to 100% of the total projected area of all AgX grains.

The number of twin planes parallel to the main planes is preferably from 2 to 4, more preferably from 2 to 3, most preferably 2. In general, the grain having two twin planes is a hexagonal tabular grain described above and the grain having three twin planes is a triangular tabular grain described above, however, a triangular tabular grain having two twin planes is sometimes present and the tabular grain in this embodiment appears when a thin tabular grain having a thickness of 0.1 μm or less is grown at a low supersaturation degree. In the edge face, a trough part and a convex part are present and the trough part has more atomic bond sites and therefore grows faster. In the case of a thin tabular grain, since the ratio (thickness/space between twin planes) is small, in many cases (area of trough part ≠ (i.e., is different from) area of convex part).

This is considered because when the grain is grown at a low supersaturation degree, the edge face of (area of trough part>area of convex part) grows faster. In the case of a grain having three parallel twin faces, it is considered because the growth rate at the edge part is such that (edge part having two troughs>edge part having one trough). The edge part having two trough parts is larger in the ratio of (number of growth activation points/unit area) and at the same time, the relation of (area of the trough>area of the convex) is maintained.

The ratio (thickness of tabular grain/distance between twin planes) or (thickness of tabular grain/distance between outermost twin planes) is preferably 1.1 or more, more preferably from 1.5 to 100, most preferably from 2 to 50. The outermost twin plane indicates the twin plane nearest to the main plane. In the present invention, the above-described hexagonal tabular grain or the grain with the corners being rounded ($0.5<b_1<1.0$) is preferred and the adjacent sides ratio is more preferably from 1 to 1.5, most preferably from 1 to 1.2. The grain satisfying the above-described conditions is called hereafter an "equilateral hexagonal tabular grain".

2. Nucleation

The temperature at the nucleation is preferably 60° C. or lower, more preferably from 10° to 50° C. The dispersion medium concentration is preferably from 0.01 to 5 wt %, more preferably from 0.01 to 1 wt %, most preferably from 0.03 to 0.6 wt %. The $X^-$ salt concentration is preferably from $10^{-0.8}$ to $10^{-3}$ mol/l, more preferably from $10^{-1.2}$ to $10^{-2.7}$ mol/l, most preferably from $10^{-1.6}$ to $10^{-2.7}$ mol/l. The $Ag^+$ solution and/or the $X^-$ solution added preferably contains a dispersion medium and the concentration thereof is preferably from 0.01 to 1 wt %, more preferably from 0.03 to 0.6 wt %. The molecular weight of the dispersion medium is preferably from 3,000 to 200,000, more preferably from 3,000 to 100,000. The pH of the reaction solution is preferably from 1 to 11, more preferably from 2 to 6. The dispersion medium is preferably gelatin, more preferably an alkali-treated gelatin, most preferably a modified gelatin described below.

In order to let the ripening proceed more rapidly at the subsequent ripening step and at the same time, to achieve a higher ratio of tabular grains, it is preferred to form fine nuclei under the condition of low AgX solubility. In other words, a low $X^-$ concentration and a low temperature are preferred. The reduction in the probability of forming twin planes accompanying the reduction in the $X^-$ concentration can be compensated by lowering the concentration of dispersion medium. Also, the pH is preferably lowered as much as possible because the AgX solubility of the dispersion medium is usually reduced.

The amount of silver salt added at the nucleation is preferably 30% or more, more preferably from 60 to 100%, most preferably from 80 to 100% and the silver salt is preferably added together with the $X^-$ salt solution by a double jet method.

3. Ripening

Among nuclei formed at the nucleation, non-tabular grain nuclei are vanished at this ripening step in an amount of preferably from 75 to 100% by number, more preferably from 90 to 100% by number, most preferably 100% by number, to increase the ratio of tabular grains in the projected area. More specifically, the solubility of the reaction solution is raised to preferably 1.1 times or more, more preferably from 1.5 to 30 times at the ripening. The solubility can be raised by the methods described in the item A-1-3 above. The lower the concentration of the dispersion medium is or the lower the pH is, the faster the ripening proceeds. This is considered because adsorptivity of the dispersion medium to the AgX grain diminishes to eliminate the inhibitory factor in the growth of tabular grains and also dissolution of non-tabular grains is accelerated. With respect to the dispersion medium concentration, the molecular weight of dispersion medium, the pH of reaction solution and the kind of dispersion medium used in the ripening, description set forth in the item 2 above can be applied. The concentration of $X^-$ salt is preferably from $10^{-0.8}$ to $10^{-2.5}$ mol/l, more preferably from $10^{-1.2}$ to $10^{-2}$ mol/l.

B. Growth Conditions of Tabular Grain

In the present invention, gelatin having a relation of the number percentage of chemically modified —$NH_2$ groups to the methionine content lying in the region $a_1$, preferably $a_2$, more preferably $a_3$ of FIG. 1 occupies from 30 to 100 wt %, preferably from 60 to 100 wt %, more preferably from 75 to 98 wt %, most preferably from 80 to 96 wt % of the dispersion medium in the dispersion medium solution used at the growing step. This embodiment can be realized by the following method:

(1) a method where after the nucleation, the ripening is conducted using a dispersion medium other than the modified gelatin (hereinafter referred to as a "non-modified mediums"), from 10 to 99.7 wt % of the dispersion medium is eliminated before the growth and then the modified gelatin is newly added;

(2) a method where the nucleation is conducted using a non-modified medium, from 10 to 99.5 wt % of the dispersion medium is eliminated after the nucleation and then the modified gelatin is newly added;

(3) a method where the nucleation is conducted using a non-modified medium in a low concentration and after the nucleation, the modified gelatin is added;

(4) a method where the nucleation and the ripening are conducted using a non-modified medium in a low concentration and after the ripening, the modified gelatin is added;

(5) a method where the nucleation and the ripening are conducted in the presence of the modified gelatin having the above concentration, which allows further addition of the modified gelatin after the nucleation or the ripening;

(6) a method where the procedure until the completion of nucleation or ripening is advanced in the presence of a non-modified gelatin and then, the gelatin is modified using a modifier described below to thereby increase the ratio of the modified gelatin; or (7) a method where the procedure until the completion of nucleation or ripening is advanced in the presence of a non-modified gelatin, then a non-modified gelatin is added and uniformly mixed and thereafter, the gelatin is modified using a modifier described below to increase the ratio of the modified gelatin.

The dispersion medium can be eliminated by the following method: 1) an AgX emulsion is centrifuged and the supernatant is removed; 2) the medium is removed by ultra-filtration using an ultrafilter; or 3) the medium is removed by sedimentation-washing with the addition of a coagulation sedimentation agent or in combination with centrifugation.

The removal ratio of the dispersion medium is preferably from 30 to 99.5 wt %, more preferably from 60 to 99%, most preferably from 90 to 99 wt %.

The above-described methods (1) to (4), (6) and (7) are more preferred. In methods (3) and (4), the low concentration means preferably from 0.01 to 1 wt %, more preferably from 0.03 to 0.6 wt %, most preferably 0.03 to 0.3 wt %. The addition amount of the modified gelatin added at a later stage is the amount necessary for achieving the embodiments of the present invention.

In order to carry out growing without thickening the tabular grain and at the same time, without broadening the size distribution, adsorptivity of the dispersion medium to the AgX grain must be precisely controlled. When $H_2O_2$ is added to an aqueous gelatin solution to oxidize the gelatin, the ratio $C_1$ (number of methionine sulfoxide group/number of methionine group) increases along the increase of the addition amount of $H_2O_2$. As the ratio $C_1$ increases, the adsorptivity of gelatin to the AgX grain is reduced. When various gelatins having different $C_1$ values are used and (111) tabular grains are grown in an aqueous solution of respective gelatins under the same conditions, the resulting tabular grain is thinner as the $C_1$ value increases but, at the same time, the size distribution is broadened. This phenomenon can be understood as follows.

Upon the above-described oxidation, a lysine group, an aspartic acid group and a glutamic acid group are thoroughly free of any change and accordingly, the above-described changes in the thickness and the size distribution are ascribable to the change in the $C_1$ value. In other words, the methionine group loses strong adsorptivity and as a result, the growth rate control in the edge face of a tabular grain transfers from the desorption rate control of the methionine group to the reaction rate control of the edge face. The growth activation site of the (111) tabular grain is in the trough part of the edge and therefore, the probability of formation of growing nuclei on the trough part in one tabular grain is proportional to the edge length in the outline of the tabular grain. Since the edge length ($2\pi d$) is proportional to the diameter (d), the probability of formation of growing nuclei is proportional to d. In the case where the growing nuclei formation step works as the growth rate-determining step, the growing rate is such that (large grain>small grain) and accordingly, the size distribution is broadened as the growing proceeds.

However, thin tabular grains are formed even when methionine is added to the oxidized gelatin in an amount of 100 μmol/g-gelatin to grow tabular grains and therefore, it cannot be said that only the methionine group alone holds the strong adsorptivity. When gelatins having various phthalization ratio are prepared by phthalizing an amino group in gelatin with phthalic anhydride and then tabular grains are grown using the same seed crystal in the dispersion medium under the same conditions, the thickness of tabular grain produced is reduced as the phthalization ratio increases but the size distribution is almost not broadened. Accordingly, in order to prepare thin tabular grains having an even size distribution, optimal combination of the methionine group content and the amino group content in gelatin must be selected. The selection of optimal values for the groups is first achieved by the present invention. 1-Phenyl-5-mercaptotetrazole strongly adsorbs to the AgX grain but the mercapto group or the tetrazole group by itself does not show so much strong adsorptivity. The same seems to go for the above-described phenomenon. Namely, the strong adsorption of gelatin to the AgX grain is considered to be ascribable to a cooperative effect of the methionine group and the $—NH_2$ group present in the gelatin molecule.

Further, when the growth is advanced with the above-described oxidized gelatin, tabular grains in the shape of a distorted hexagon are formed, but when gelatin having the relation in the region $a_1$, preferably $a_2$ in FIG. 1 is used, equilateral hexagonal tabular grains are formed.

Another important factor in controlling adsorptivity of the dispersion medium to the AgX grain is a temperature. Even in the same dispersion medium, as the temperature lowers, the frequency of desorption of the adsorptive group diminishes and the grain growth inclines more to the growth subject to desorption rate control. In this case, nearly uniform growth takes place on the entire surface of a tabular grain. Accordingly, as the temperature is elevated, the desorption rate control is eliminated to increase selective growth at edges and as a result, tabular grains having a higher aspect ratio are obtained. If the same tabular grains are grown using various dispersion media at various temperatures from 30° to 80° C., the change in the aspect ratio of resulting tabular grains is large in the case of gelatin having a high methionine content and at the same time, a high free amino group content. In the embodiments of the present invention, the change in temperatures is small and monodisperse tabular grains having a high aspect ratio can be obtained over a wide temperature range. Also, since the proper adsorptivity to an AgX grain can be maintained, generation of fog is restrained and grains having a high (sensitivity/fog) ratio can be obtained. The growth temperature is preferably 30° C. or higher, more preferably from 40° to 90° C. The most preferred temperature can be selected therefrom.

Still another important factor in controlling the adsorptivity of the dispersion medium to the AgX grain is a pH. When dispersion medium solutions having various pH values are prepared using an oxidized gelatin containing no methionine and the same (111) tabular seed crystal is placed in each solution to grow, the population ratio of thick tabular grains is increased as the pH value rises. This is outstanding at a pH of 8 or more, particularly at a pH of 9 or more. In this case, since the methionine sulfoxide is not changed, it is revealed that the methionine is not only the cause of production of thick tabular grains. On the other hand, when a modified gelatin of the present invention is used, the pH dependency is low and population of thick grains does not occur at a pH of from 9 to 10. More specifically, a greater advantage can be obtained at a growth pH of preferably from 9 to 11, more preferably from 6 to 10.

In the case of a (100) tabular grain, as the pH in ripening and growing is rendered higher, thinner tabular grains can be obtained. The relation and cause of these are set forth in Table 1. In Table 1, "Gel." indicates gelatin.

TABLE 1

| | Low pH | High pH |
|---|---|---|
| Charge of gelatin, adsorptivity to surface of AgX grain | Gel. $H_3\overset{+}{N}$ ---- S ---- COOH<br>⋮<br>$Ag^+$<br>van der Waals bonding<br>• When adsorptivity to $Ag^+$ of (100) face is decreased, growth rate of (100) face is increased, Coulomb adsorptivity to $X^-$ of (111) face is increased, and concentration of complex of Gel. ---- $Ag^+$ is decreased.<br>→ with low $X^-$ concentration, AgX solubility is decreased. | Gel. $H_2N$ ---- S ---- $COO^-$<br>$Ag^+$<br>• When adsorptivity to $Ag^+$ of (100) face is increased, growth rate of (100) face is decreased, Coulomb adsorptivity to $X^-$ of (111) face is decreased, and concentration of complex of Gel. ---- $Ag^+$ is increased.<br>→ even with low $X^-$ concentration, AgX solubility is increased. |
| (111) Tabular grain | Due to weak adsorptivity of Gel. to $Ag^+$ of (100) face at edges, growing property at edge plane is increased. When adsorptivity of Gel. to $X^-$ of main plane is increased, growing property on the main plane is | Due to strong adsorptivity of Gel. to $Ag^+$ of (100) face at edges, the growing property at edge face is decreased. When adsorptivity of Gel. to $X^-$ of main plane is decreased, growing |

TABLE 1-continued

| | Low pH | High pH |
|---|---|---|
| | decreased → aspect ratio becomes high. (100) face is difficultly formed → formation of (111) face is accelerated → at nucleation, probability of formation of twin plane is increased. | property on the main plane is increased → aspect ratio becomes high. (100) face is readily formed → at nucleation, probability of formation of twin plane is decreased. |
| (100) Tabular grain | Due to weak adsorptivity of Gel. to $Ag^+$ of (100) face on main plane, growing property on the main plane is increased. As a result, supply of solute ions to edge face is decreased → aspect ratio becomes low. | Due to strong adsorptivity of Gel. to $Ag^+$ of (100) face on main plane, the growing property on the main plane is decreased. Due to the presence of screw dislocation defect on edge face, the growth on edge face continues → aspect ratio becomes high. |

These tabular grains are preferably grown at the most preferred supersaturation degree selected depending upon the purposes. The supersaturation degree is preferably from 5 to 90, more preferably from 10 to 80 assuming that the critical supersaturation degree is 100 and the super-saturation degree when a solute is not added is 0. The term "critical super-saturation degree" as used herein means the super-saturation degree in the state where new nuclei are generated if an aqueous $AgNO_3$ solution and an aqueous $X^-$ salt solution are added by a double jet method at a higher speed. If the supersaturation degree is increased, the resulting tabular grains are monodispersed to a higher extent, but the growth proceeds also in the thickness direction to result in a low aspect ratio. If the super-saturation degree is decreased, a high aspect ratio can be achieved but the size distribution is broadened.

The concentration of the dispersion medium at the growing step is preferably from 0.1 to 7 wt %, more preferably from 0.3 to 3 wt %. The molecular weight is preferably from 3,000 to 200,000, more preferably from 6,000 to 120,000. The pH of the solution is preferably a pH higher than the isoelectric point of the modified gelatin, more preferably of from (isoelectric point+0.2) to 11, most preferably of from (isoelectric point+0.4) to 10. If tabular grains are grown under the same conditions, as the pH is lowered, as the gelatin concentration is reduced and as the molecular weight is decreased, the tabular grains produced have a higher aspect ratio. The most preferred combination of these can be selected depending upon the purpose.

At the ripening and the growing of a (111) tabular grain, the $X^-$ concentration in the reaction solution is preferred to lie in the region for forming an octahedral grain. The term "region for forming an octahedral tabular grain" as used herein means the concentration range where when $Ag^+$ and $X^-$ are added by a double jet method while keeping the above-described condition for the $X^-$ concentration to form AgX grains, grains in which {111} faces occupy preferably from 70 to 100%, more preferably from 90 to 100% of a grain surface are formed. Usually, the $X^-$ concentration is preferably from $10^{-0.5}$ to $10^{-2.5}$ mol/l, more preferably from $10^{-1}$ to $10^{-2}$ mol/l.

The above-described characteristics are also seen in a (100) tabular grain in addition to a (111) tabular grain. Accordingly, the same condition can be preferably applied to the (100) tabular grain. At the nucleation, the ripening and the growing of a (100) tabular grain, the $X^-$ concentration in the reaction solution preferably lies in the region for forming a cubic grain. The term "region for forming a cubic grain" as used herein indicates the concentration range where when $Ag^+$ and $X^-$ are added by a double jet method while keeping the above-described condition for the $X^-$ concentration to form AgX grains, grains in which {100} faces occupy preferably from 70 to 100%, more preferably from 90 to 100% of a grain surface are formed. Usually, the $X^-$ and $Ag^+$ concentrations each is preferably $10^{-1.5}$ mol/l or less, more preferably $10^{-2}$ mol/l or less.

With respect to the details of the tabular grain other than those described above, literatures cited in the "BACKGROUND OF THE INVENTION", JP-A-3-288143, JP-A-3-212639, JP-A-3-116133, JP-A-2-301742, JP-A-2-34, JP-A-6-59360, Japanese Patent Application Nos. 6-47991, 5-248218, 5-264059 and 5-96250 and literatures described later can be referred to.

C. Modified Gelatin

The —$NH_2$ group in gelatin includes a terminal amino group of a gelatin molecule, and the amino groups of the lysine group, the hydroxylysine group, the histidine group or the arginine group and, if the arginine group is converted into an ornithine group, an amino group in the ornithine group. Impurity groups such as adenine and guanine are also included. The chemical modification of the —$NH_2$ group is to form a covalent bond or deaminate by adding a reaction reagent to gelatin to react with the amino group. In other words, it is to convert the primary amino group (—$NH_2$) into a secondary amino group (—NH—), a tertiary amino group or a deaminated product.

More specifically, the chemical modification can be achieved by adding and reacting, for example, an acid anhydride (e.g., maleic anhydride, o-phthalic anhydride, succinic anhydride, isatoic anhydride, benzoic anhydride), an acid halide (e.g., R—COX, R—$SO_2$X, R—O—COX, Phenyl—COCl), a compound having an aldehyde group (e.g., R—CHO), a compound having an epoxy group, a deaminating agent (e.g., $HNO_2$, deaminase), an active ester compound (e.g., sulfonate, p-nitrophenylacetate, isopropenylacetate, methyl o-chloro-benzoate, p-nitrophenylbenzoate), an isocyanate compound (e.g., aryl isocyanate), an active halogen compound [for example, an aryl halide (e.g., benzyl bromide, biphenylhalo-methanes, benzoylhalomethane, phenylbenzoylhalomethane and 1-fluoro-2,4-dinitrobenzene), β-ketohalide, α-haloaliphatic acid, β-halonitrile and a chloro derivative of s-triazine, pyrimidine, pyridazine, pyrazine, pyridazone, quinoxaline, quinazoline, phthalazine, benzoxazole, benzothiazole or benzoimidazole], a carbamoylating agent (e.g., cyanate, nitrourea), a compound having an acryl-type active double bond group (maleimide, acrylamine, acrylamide, acrylonitrile, methylmethacrylate, vinyl sulfone, vinylsulfonate ester, sulfonamide, styrene and vinylpyridine, allylamine, butadiene, isoprene, chloroprene), a sultone (e.g., butane sultone, propane sultone), a guanidinating agent (e.g., o-methyl-isourea) or a carboxylazide.

A reagent which reacts mainly with the —$NH_2$ group of gelatin is preferred rather than a reagent which reacts also with the —OH group or —COOH group in gelatin to form a covalent bond. The term "mainly" as used herein means preferably 60% or more, more preferably from 80 to 100%, most preferably from 95 to 100%. In a more preferred embodiment, the reaction product contains substantially no group resulting from replacing the oxygen of an ether group or a ketone group by a chalcogen atom, such as —S— or a thione group. The term "substantially no" as used herein indicates preferably 10% or less, more preferably from 0 to 3% of the number of chemically modified groups. Accordingly, among the above-described compounds, more preferred are an acid anhydride, a sultone, a compound having an active double bond group, a carbamoylating agent, an active halogen compound, an isocyanate compound, an active ester compound, a compound having aldehyde and a deaminating agent. In a still more preferred embodiment, crosslinking between gelatin molecules is substantially inhibited by the chemical modification. The term "substantially inhibited" as used herein indicates preferably 10% or less, more preferably from 0 to 3% of chemically modified groups.

With respect to the details of the chemical modification agent or the chemical modification method of gelatin other than those described above, literatures described later, JP-A-4-226449, JP-A-50-3329, U.S. Pat. Nos. 2,525,753, 2,614,928, 2,614,929, 2,763,639, 2,594,293 and 3,132,945, Yoshihiro Abiko, *Glue and Gelatin*, Chap. II, Japan Glue.Gelatin Kogyo Kumiai (1987), and Ward et al., *The Science and Technology of Gelatin*, Chap. 7, Academic Press (1977) can be referred to.

The chemical modification percentage of the —$NH_2$ group in the modified gelatin can be obtained as follows. A non-modified gelatin and a modified gelatin are prepared, the numbers $e_1$ and $e_2$ of —$NH_2$ groups in both gelatins are obtained and then the chemical modification percentage can be calculated from the equation: $100\times(e_1-e_2)/e_1$. The group numbers $e_1$ and $e_2$ can be obtained using an infrared absorption strength based on the —$NH_2$ group, an NMR signal strength of the proton, a coloring reaction or a fluorescent reaction and for the details thereon, *Bunseki-Kagaku Bin'ran, Yukihen*-2, Maruzen (1991) can be referred to. In addition, change in the titration curve of gelatin or quantitation such as formol titration can be used and for the details thereon, *The Science and Technology of Gelatin*, Chap. 15, Academic Press (1977) can be referred to.

Also, they can be obtained by adding a mixture of glutaraldehyde and Britton-Robinson high pH buffer to a gelatin solution in a predetermined concentration, coloring the solution, determining the spectral absorption strength near 450 nm and effecting colorimetric determination thereon [see, *Photographic Gelatin. II*, pp. 297–315, Academic Press (1976)].

The methionine content of gelatin can be obtained by decomposing gelatin with alkali hydrolysis completely to amino acids and subjecting them to an amino acid analyzer to determine the amount of methionine to the amount of glycine. For the details thereon, Japanese Patent Application No. 6-102485 can be referred to. The methionine content of gelatin can be controlled by adding an oxidizing agent to an aqueous gelatin solution and oxidizing the —S— group in the methionine to one or more of sulfoxide, sulfonate and sulfone, preferably to sulfoxide. In other words, the oxidation product of methionine is not included in the methionine of the present invention. The oxidation level can be controlled mainly by the kind of an oxidizing agent added and the addition amount thereof. The temperature of the gelatin aqueous solution is preferably from 10° to 70° C., more preferably from 25° to 50° C. The pH of the solution is preferably from 2 to 9, more preferably from 3 to 7. Commonly, an oxidizing agent is added to an aqueous gelatin solution adjusted to have a constant temperature and a constant pH and uniformly mixed therewith. Thereafter, the vessel is covered and the mixture is allowed to stand at a constant temperature and to age for preferably from 15 minutes to 3 days, more preferably from 1 to 24 hours. With respect to the oxidizing agent, Japanese Patent Application No. 6-102485 can be referred to. Usually, $H_2O_2$ is preferred.

Due to the oxidation, the extinction coefficient (in the wavelength region of from 200 to 500 nm) of gelatin is lowered. Accordingly, once the relation between the above-described extinction coefficient and the methionine content is determined by preparing reagents on various oxidation levels, then the methionine content of gelatin can be simply obtained by determining the extinction coefficient. The amino acid composition of a standard gelatin is described in *The Theory of the Photographic Process*, Chap. 2, Macmilan (1977) and eight molecules of the methionine is contained in one molecule of gelatin. Assuming that the molecular weight of gelatin is 96,000, then the methionine content is 83 μmol/g and thus, gelatin can be said to have conventionally a methionine content in the vicinity of about 80 μmol/g. In the regions $a_1$ and $a_2$ of FIG. 1, the methionine content is preferably 60 μmol/g or less, more preferably 50 μmol/g or less, more preferably 40 μmol/g or less, most preferably 36 μmol/g or less. In the region $a_3$ of FIG. 1, the methionine content is preferably 40 μmol/g or less.

D. PAO Polymer

A polyalkyleneoxide polymer (hereinafter referred to as a "PAO polymer") is preferably added during the time period between prior to nucleation and 5 minutes (preferably 10 minutes) before completion of the growth, more preferably between after nucleation and immediately before initiation of the growth. The polymer is more preferably added in forming the above-described tabular grain, more specifically, in forming a (111) tabular grain having a $Br^-$ content of from 50 to 100 mol %. As the PAO polymer used in the present invention, the compounds described in EP 0514742A1 and JP-A-6-332090, JP-A-7-28183 and JP-A-6-242526 in detail are preferred, and the embodiments described in JP-A-7-28183 and JP-A-6-242526 are particularly preferred. The molecular weight of the PAO polymer in the first to sixth embodiments is preferably from 500 to $10^6$ more preferably from $10^3$ to $10^5$. The addition amount of the PAO polymer in the first and second embodiments is preferably from 0.001 to 20 g/l, more preferably from 0.003 to 10 g/l. The addition amount of each the polymers in the third to sixth embodiments is preferably from 0.01 to 20 g/l, more preferably from 0.03 to 10 g/l. The pH at the grain growth time is preferably from 5 to 11, more preferably from 5 to 9.5.

The order of the adsorption strength (i.e., adsorptivity) of the organic ether compounds to the AgX grain is commonly —O—<—S—<—Se—<—Te—. The adsorptivity of an oxygen ether group to the AgX grain is weaker than that of a thioether group and accordingly, the group does not strongly inhibit the growth of the AgX grain. The adsorption thereof to the AgX grain is based on van del Waals bonding and therefore, the oxygen ether group adsorbs selectively to {100} faces rather than to {111} faces of the AgX grain. This is because in the AgX grain, the {100} face has $Ag^+$ and $X^-$ and is greater in the induced dipole moment than the {111} face. In the (111) tabular grain, {100} faces readily appears on edge faces and so, PAO adsorbs to the edge face with an appropriate adsorptivity rather than to the main plane. Then, the growing rate control on the edge face is changed to the desorption rate control of PAO. If the adsorbed molecular number of PAO per the unit area is same, a large grain and a small grain show an equal growth rate per the unit area. As a result, edge faces grow at an equal rate both in a large grain and a small grain and thus, the coefficient of variation in the diameter distribution is reduced as the growing proceeds.

The crystal habit dependency in the adsorption of the PAO polymer can be determined as follows. A monodispersed cubic grain emulsion and an octahedral grain emulsion are prepared to have the same surface area, a PAO compound is added to each emulsion and after reaching an adsorption equilibrium and then centrifuged, each supernatant is analyzed. For example, in the case when the temperature is higher than the clouding point of the PAO, the spectral transmission strength may be compared, for determining the crystal habit dependency. In addition, the PAO component may be separated and analyzed by chromatography (for example, gel filtration chromatography). Further, the cubic and octahedral grains are measured on their ion conductivity by the dielectric loss method and variations in the ion conductivity due to the adsorption may be obtained and compared.

A conventional gelatin usually shows more intensified adsorption to the {100} face of the AgX grain than to the {111} face thereof. This is because the adsorption takes place mainly based on the interaction with $Ag^+$ which is present on the grain surface. In this case, the adsorption of the PAO polymer to the {100} face is inhibited. However, in the case of the modified gelatin, the adsorption to the AgX grain is weak and therefore, selective adsorption of the PAO polymer to the {100} face can take place to provide a preferred growth property in the above-described embodiment. The PAO polymer is considered to interact intensely with $Br^-$ on the {100} face because the ion conductivity of the AgBr grain increases after the adsorption of the PAO polymer.

The interaction between the PAO polymer and $X^-$ in an aqueous solution can be determined as follows. An $X^-$ selection electrode is placed in each of an aqueous solution containing the PAO and an aqueous solution free of the PAO, the relation between the addition amount of the $X^-$ salt and the electrode potential (v. standard electrode) is obtained and comparison is made between two aqueous solutions. The potential variation is reduced by the amount of $X^-$ incorporated into the PAO polymer.

A first embodiment of the PAO polymer is HPAO which is represented by formula (1)-a) or (1)-b). In this embodiment, an embodiment (HP1) where the molecular weight of HPEOU occupies preferably from 96.1 to 100%, more preferably from 97 to 100%, of the molecular weight of the entire molecule and an embodiment (HP2) where the above-described occupation is from 4 to 96% are included.

In formulae (1)-a) and (1)-b), $R^0$ represents H or a hydrocarbon (e.g., $—CH_2OH$, $—C_2H_5OH$ and $—CH_2—O—CH_3$) containing at least one polar group and having from 1 to 10 carbon atoms, preferably H. R represents an alkylene group having from 3 to 10 carbon atoms and specific examples thereof include $—CH(CH_3)CH_2—$, $—CH_2CH(CH_3)—$, $—CH_2CH_2CH_2—$, $—(CH_2)_4—$, $—(CH_2)_5—$ and $—CH_2CH(C_6H_5)—$, with $—CH(CH_3)CH_2—$ and $—CH_2CH(CH_3)—$ being particularly preferred. n and m each represents an average number of the repeating unit of 4 or more (preferably from 6 to 10,000, more preferably from 10 to 2,000) satisfying the above-described requirement for the molecular weight.

However, since the selectivity for the open ring position of a cyclic ether at the polymerization is not satisfactorily high, for example, $—[CH_2CH(CH_3)O]—$ and $—[CH(CH_3)CH_2O]—$ may mingle in the compound represented by formula (1).

A second embodiment of the PAO polymer is PEOD which is represented by formula (2)-a), (2)-b), (2)-c), (2)-d), (2)-e) or (2)-f), wherein LPU indicates a lipophilic group other than an HO-HPEOU-group or an HO-LPAOU-group and represents a substituted or unsubstituted alkyl group, a substituted or unsubstituted alkenyl group, a substituted or unsubstituted aryl group, a substituted or unsubstituted heterocyclic group, a substituted or unsubstituted alkoxy group, a substituted or unsubstituted aryloxy group, a substituted or unsubstituted acyl group, a substituted or unsubstituted acylamino group, a substituted or unsubstituted alkylthio group, a substituted or unsubstituted arylthio group, a substituted or unsubstituted alkoxycarbonyl group, a substituted or unsubstituted aryloxycarbonyl group or a substituted or unsubstituted alicyclic group, with compounds free of divalent sulfur, selenium or tellurium being more preferred.

The above substituted groups may be preferably substituted with a substituent group selected from the group consisting of $C_dH_{2d+1}—$ and $C_dH_{2d+1}CO—$ (d=an integer of from 1 to 12).

LPU' represents a hydrogen atom or an alkyl group having 1 to 20 carbon atoms which is the same as for $R^2$ described below.

Specific compound examples of HPAO and specific compound examples of PEOD include those represented by formulae (10)-a) to (10)-c) and formulae (11)-a) and g), respectively.

(10)

$$HO\text{-}(CH_2CH_2O)_{n1}\text{-}H \quad \text{a)}$$

$$HO(CH_2CH_2O)_{n1}\text{-}(CH(CH_3)CH_2O)_{n2}\text{-}(CH_2CH_2O)_{n3}\text{-}H \quad \text{b)}$$

$$HO\text{-}(CH(CH_3)CH_2O)_{n2}\text{-}(CH_2CH_2O)_{n1}\text{-}(CH(CH_3)CH_2O)_{n4}\text{-}H \quad \text{c)}$$

(11)

$$C_aH_{2a+1}COO\text{-}(CH_2CH_2O)_{n1}\text{-}H \quad \text{a)}$$

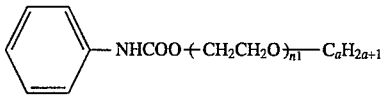

$$\text{— NHCOO-}(CH_2CH_2O)_{n1}\text{-}C_aH_{2a+1} \quad \text{b)}$$

$$C_aH_{2a+1}\text{—CO—N}\begin{cases}(CH_2CH_2O)_{n1}\text{—H}\\(CH_2CH_2O)_{n2}\text{—H}\end{cases} \quad \text{c)}$$

$$C_aH_{2a+1}\text{CO—N}\begin{cases}(CH_2CH_2O)_{n1}\text{—H}\\(CH_2CH_2O)_{n2}\text{—H}\end{cases} \quad \text{d)}$$

-continued e) $C_aH_{2a+1}-O(CH_2CH_2O)_{n1}-C_bH_{2b+1}$ f)

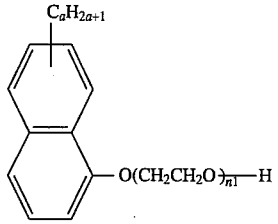

g)

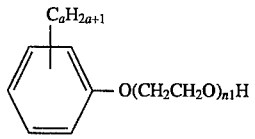

In the above formulae, a and b each represents an integer of from 1 to 25, $n_1$ to $n_3$ each represents a value of from 1 to 10,000 satisfying the above-described requirement for the molecular weight of HPAO or PEOD. For the details of polymers in the first and second embodiments other than those described above, JP-A-6-332090 can be referred to.

In a third embodiment of the PAO polymer, at least one polymer having a repeating unit of the monomer represented by formula (3) (which is the same as in the formula (7)-a) described below) is contained. The polymer may be a copolymer of other monomer described hereinafter. In the case, the monomer represented by formula (3) in the polymer occupies preferably 1 to 100 wt %, more preferably 10 to 90 wt % of the polymer. A fourth embodiment of the PAO polymer is a copolymer of at least two monomers, one being a monomer represented by formula (3) and another being a monomer represented by formula (4) (which is the same as in the formula (7)-c) described below), mixed at a molar ratio of from 1:100 to 100:1, preferably from 5:100 to 100:5.

In formulae (3) and (4), $R^1$ and $R^4$, which may be the same or different, each represents H or a lower alkyl group having from 1 to 4 carbon atoms (e.g., methyl, ethyl, n-propyl, n-butyl), with H and a methyl group being particularly preferred. $R^2$ and $R^5$, which may be the same or different, each represents a monovalent substituent having 1 to 20 carbon atoms and preferably represents H, a substituted or unsubstituted alkyl group, a substituted or unsubstituted aryl group or an acyl group, more preferably H, $CH_3$—, $C_2H_5$—, $C_6H_5$— or $CH_3CO$—. n and m each represents an average number of the repeating unit, where n is generally from 4 to 600, preferably from 4 to 200 and m is generally from 4 to 600, preferably from 4 to 200. L and L' each represents a divalent linking group.

Examples of the divalent linking group include —COO—, —CONH—, —CONH—$(CH_2)_c$—COO—,

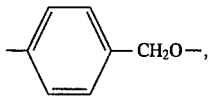

—$COOCH_2CH_2O$— and —$CON(CH_3)$—, wherein c is an integer of 1 to 20.

Specific examples of the monomer represented by formula (3) include the following.

| | | |
|---|---|---|
| (3)-a)-1) | $CH_2=C(CH_3)-COO+CH_2CH(CH_3)O]_n-H$ | n = 6 |
| (3)-a)-2) | " | n = 9 |
| (3)-a)-3) | " | n = 12 |
| (3)-a)-4) | " | n = 20 |
| (3)-a)-5) | " | n = 40 |
| (3)-a)-6) | $H_2C=C(CH_3)-COO-(CH_2CH(CH_3)O)_9-CH_3$ | |
| (3)-a)-7) | $H_2C=C(CH_3)-COO-(CH_2CH(CH_3)O)_9$ 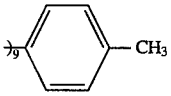 $-CH_3$ | |
| (3)-a)-8) | $H_2C=C(CH_3)-COO+CH_2CH(CH_3)O)_9+CH_2CH_2CH_2CH_2O)_9-H$ | |
| (3)-a)-9) | $H_2C=CH-CONH+CH_2CH(CH_3)O)_9-H$ | |
| (3)-a)-10) | $H_2C=CH-CONH-(CH_2)_6-COO+CH_2CH_2CH(CH_3)O)_9-H$ | |
| (3)-a)-11) | $H_2=CH-$ 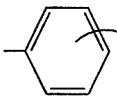 $-CH_2O+CH_2CH(CH_3)O)_9-CH_3$ | |

Specific examples of the monomer represented by formula (4) include the following.

| | | |
|---|---|---|
| (4)-a)-1) | $CH_2=C(CH_3)-COO-(CH_2CH_2O)_n-CH_3$ | n = 4 |
| (4)-a)-2) | " | n = 9 |
| (4)-a)-3) | " | n = 15 |
| (4)-a)-4) | " | n = 23 |
| (4)-a)-5) | " | n = 50 |

In the copolymer, the monomer represented by formula (3) occupies preferably from 1 to 90 wt %, more preferably from 5 to 85 wt %, most preferably from 15 to 70 wt %.

In the above copolymer, the monomer represented by formula (4) occupies preferably from 1 to 90 wt %, more preferably from 3 to 70 wt %, most preferably from 10 to 50 wt %.

The monomer of formula (3) and/or the monomer of formula (4) may be copolymerized with other monomer. Specific examples of the other monomer to be copolymerized include acrylates, methacrylates, acrylamides, methacrylamides, vinyl esters, vinyl ketones, allyl compounds, olefins, vinyl ethers, N-vinylamides, vinyl heterocyclic compounds, maleates, itaconates, fumarates and crotonic acid esters. The copolymerization amount of the other monomer subjected to copolymerization is preferably from 0 to 99 wt %, more preferably from 0 to 90 wt %, most preferably from 5 to 60 wt %.

Specific examples of the copolymer of the monomer represented by formula (3), the monomer represented by formula (4) and the other monomer include those shown by formulae (12)-1) to (12)-5). In the parentheses, a weight percentage of each monomer in the polymer is shown.

| | | |
|---|---|---|
| (12)-a)-1) | (3)-a)-3)/(4)-a)-4)/acrylamide copolymer | (5/5/90) |
| (12)-a)-2) | (3)-a)-3)/(4)-a)-4)/acrylamide copolymer | (10/10/80) |
| (12)-a)-3) | (3)-a)-3)/(4)-a)-4)/acrylamide copolymer | (25/25/50) |
| (12)-a)-4) | (3)-a)-3)/(4)-a)-4)/acrylamide copolymer | (35/35/30) |
| (12)-a)-5) | (3)-a)-3)/(4)-a)-4) copolymer | (50/50) |

For the details of the PAO polymer in the third and fourth embodiments other than those described above, JP-A-7-28183, (description in the sixth embodiment described hereinafter) may be referred to.

In a fifth embodiment of the PAO polymer, the above-described dispersion medium solution comprises at least one polymer containing the repeating unit represented by formula (5) in an amount of 1 wt % or more and at least one polymer containing the repeating unit represented by formula (6) in an amount of 1 wt % or more, each in a concentration described above.

In formulae (5) and (6), R represents an alkylene group having from 3 to 10 carbon atoms and specific examples thereof include $—CH(CH_3)CH_2—$, $—CH_2CH(CH_3)—$, $—CH_2CH_2CH_2—$, $—(CH_2)_4—$, $—(CH_2)_5—$ and $—CH_2CH(C_6H_5)—$, with $—CH(CH_3)CH_2—$ and $—CH_2CH(CH_3)—$ being particularly preferred.

n and m each represents an average number of the repeating unit of 4 or more (preferably from 6 to 10,000, more preferably from 10 to 2,000) satisfying the requirement for the molecular weight.

A sixth embodiment of the PAO polymer is an embodiment resulting from adding the following limitations to the fifth embodiment. The polymer represented by formula (5) is at least one polymer selected from polymers containing a vinyl polymer of the monomer represented by formula (7)-a) and a polyurethane represented by formula (7)-b) , and the polymer represented by formula (6) is at least one polymer selected from polymers containing a vinyl polymer of the monomer represented by formula (7)-c), a polyurethane represented by formula (7)-d) and a substituted or unsubstituted polyethylene glycol.

In formulae (7)-a) to (7)-d), n and m each represents a value of preferably 4 or more, more preferably from 4 to 600, most preferably from 4 to 80. R, $R^1$, $R^2$, $R^4$, $R^5$, L and L', each has the same meaning as described above. $R^{11}$, $R^{12}$, $R^{13}$ and $R^{14}$ each represents a divalent linking group and specifically, an alkylene group having from 1 to 20 carbon atoms, a phenylene group having from 6 to 20 carbon atoms or an aralkylene group having from 7 to 20 carbon atoms. x, y, z, x', y' and z' each represents a weight percentage of each component where x and x' each is from 1 to 70, preferably from 5 to 40, y and y' each is from 1 to 70, preferably from 3 to 50, and z and z' each is from 20 to 70, preferably from 30 to 60, provided that x+y+z=100 and x'+y'+z'=100.

The repeating unit represented by —(R—O)— may be used in the polymer as a sole kind or in combination of two or more kinds. Or, the repeating unit —(R—O)— or $—(CH_2CH_2O)—$ may be used in combination of two or more kinds thereof different in the average number (molecular weight) of the repeating unit.

The polymer represented by formula (5) can be preferably used if it contains the repeating unit of formula (5) but a copolymer containing a vinyl polymer of the monomer represented by formula (7)-a) or a polyurethane represented by formula (7)-b) are preferably used and the vinyl polymer is more preferably used.

Specific examples of the monomer represented by formula (7)-a) include those represented by formulae (7)-a)-1) to (7)-a)-5) [which are the same as in formulae (3)-a)-1) to (3)-a)-5)].

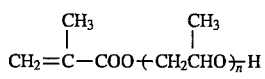

(7)-a)-1) n = 6

(7)-a)-2) n = 9

(7)-a)-3) n = 12

(7)-a)-4) n = 20

(7)-a)-5) n = 40

In the vinyl polymer, the monomer unit represented by formula (7)-a) occupies generally from 1 to 100 wt %, preferably from 10 to 90 wt %, more preferably from 30 to 70 wt %. Specific examples of the vinyl polymer comprising the monomer represented by formula (7)-a) include those represented by formulae (8)-a)-1) to (8)-a)-3) and specific examples of the polyurethane represented by formula (7)-b) include those represented by formulae (8)-b)-1) and (8)-b)-2). In the parentheses, a weight percentage is shown.

(8)-a)-1): (7)-a)-3)/acrylamide copolymer (25/75)

(8)-a)-2): (7)-a)-3)/acrylic acid/acrylamide copolymer (50/30/20)

(8)-a)-3): (7)-a)-3)/acrylic acid copolymer (70/30)

(8)-b)-1): isophorone diisocyanate/sodium 2,2-bis-(hydroxymethyl)propionate/polypropylene oxide (molecular weight: 400)/polypropylene oxide (molecular weight: 1,000) (43.1/21.5/15.7/19.7) (8)-b)-2): toluene diisocyanate/sodium 2,2-bis(hydroxymethyl)butanate/polypropylene oxide (molecular weight: 1,000) (29.3/20.1/50.6)

The above-described polyurethane is fundamentally synthesized by the addition of a diol compound and a diisocyanate compound.

The polymer represented by formula (6) can be preferably used if it contains the repeating unit represented by formula (6) but the homopolymer or copolymer of the monomer represented by formula (7)-c), polyethylene glycol, substituted polyethylene glycol and polyurethane represented by formula (7)-d) are preferably used and the homopolymer of the monomer represented by formula (7)-c) is more preferably used.

The monomer represented by formula (7)-c ) can be copolymerized with other ethylenically unsaturated monomer. In the copolymer of the case, the monomer represented by formula (7)-c) occupies generally from 1 to 100 wt %, preferably from 10 to 80 wt %, more preferably from 30 to 70 wt %. Specific examples of the monomer represented by formula (7)-c) include the following [which are the same as in formulae (4)-a)-l)to (4)-a)-5)].

| $CH_2{=}CH(CH_3)—COO—(CH_2CH_2)_n—CH_3$ | |
|---|---|
| (7)-c)-1) | n = 4 |
| (7)-c)-2) | n = 9 |
| (7)-c)-3) | n = 15 |
| (7)-c)-4) | n = 23 |
| (7)-c)-5) | n = 50 |

In addition, the polymer having the repeating unit represented by formula (6) includes polyethylene glycol, substituted polyethylene glycol containing a substituent having from 1 to 30 carbon atoms and polyurethane. In the polyurethane polymer represented by formula (7)-d), the polyethylene oxide occupies generally from 1 to 70 wt %, preferably from 5 to 40 wt %.

Specific examples of the copolymer comprising the monomer represented by formula (7 )-c ) include those represented by formulae (8)-c )-1) to (8)-c )-4) and specific examples of the polymer represented by formula (7)-d) include those represented by formulae (8)-d)-1) and (8)-d)-2).

| | | |
|---|---|---|
| (8)-c)-1): | (7)-c)-3)/acrylamide copolymer | (10/90) |
| (8)-c)-2): | " | (25/75) |
| (8)-c)-3): | " | (50/50) |
| (8)-c)-4): | (7)-c)-3) homopolymer | |
| (8)-d)-1): | toluene diisocyanate/sodium 2,2-bis(hydroxymethyl)butanate/polyethylene glycol (molecular weight: 1,000) | (29.3/20.1/50.6) |
| (8)-d)-2): | 4,4'-diphenylmethanediisocyanate/sodium 2,2-bis(hydroxymethyl)propionate/polyethylene glycol (molecular weight: 400) | (45.3/11.3/43.4) |

For the details of the fifth and sixth embodiments other than those described above, JP-A-7-28183 can be referred to.

In the present invention, the embodiment HP1 in the first embodiment and the second to sixth embodiments are preferred, the second to sixth embodiments are more preferred, the third to sixth embodiments are still more preferred and the fifth and sixth embodiments are most preferred.

For the details of the PAO polymer other than those described above, Davidsohn et al., *Synthetic Detergents*, John Wiley & Sons, New York (1987), Tadanori Misawa, *Suiyosei Kobunshi*, Kagaku Kogyo Sha (1990), Hiroshi Horiguchi, *Shin Kaimen Kasseizai*, Sankyo Shuppan (1975), Takehiko Fujimoto, *Shin Kaimen Kasseizai Nyumon*, Sanyo Kasei Kogyo (1976), *Kagaku Binran*, edited by Nippon Kagaku Kai, Chap. 4-Sec. 6, Maruzen (1984), Tokiyuki Yoshida et al., *Kaimen Kasseizai Handbook*, Kogaku Tosho, and literatures described below may be referred to.

Depending upon the halogen composition or the growth conditions (temperature, pH, pAg, etc.) of the AgX grain, the optimum addition amount ratio of the polymer represented by formula (5) to the polymer represented by formula (6) varies. In the fifth and sixth embodiments, the optimum conditions can be determined by preparing two polymers and changing the addition ratio. However, in the fourth embodiment, the polymer must be prepared by variously changing the polymerization ratio of the monomer represented by formula (3) to the monomer represented by formula (4) and thus, the preparation is cumbersome. Also, the polymer is diversified in the kind and yielded in a small amount to raise the cost. Accordingly, in this point of view, the fifth and sixth embodiments are superior to the fourth embodiment. D. Method for Feeding $Ag^+$ and $X^-$.

In the growing step, $Ag^+$ and $X^-$ are supplied by 1) an ion solution addition method where a silver salt solution having dissolved therein a soluble silver salt and a halogen salt solution having dissolved therein a soluble halogen salt (referred to "$X^-$ salt solution") are supplied, 2) a method where an AgX fine grain emulsion is previously prepared and the fine grain emulsion is supplied, 3) a splash addition method and 4) a combination of two of the above-described methods. The soluble silver salt or the soluble halogen salt has the solubility in water at room temperature of generally 1 wt % or more, preferably 10 wt % or more and *Kagaku Binran*, edited by Nippon Kagaku Kai, Chap. 8, Maruzen (1993) may be referred to thereon. Usually, $AgNO_3$ and alkali metal salts or ammonium salts of $Cl^-$, $Br^-$ or $I^-$ are preferably used. The AgX fine grain has a grain size (diameter of a circle having an area equal to the projected area of a grain) of preferably 0.15 μm or less, more preferably from 0.01 to 0.1 μm and most preferably from 0.02 to 0.06 μm. The halogen composition includes AgCl, AgBr, AgI and a mixed crystal of two or more of these.

The coefficient of variation in the size distribution is preferably from 0 to 0.4, more preferably from 0 to 0.2, most preferably from 0 to 0.1.

The fine grain preferably contains substantially no double or more twin planes and also preferably contains substantially no single twin grain. Further, the fine grain preferably contains substantially no screw dislocation defect. The term "substantially no" as used herein means preferably 3% by number or less, more preferably 1% by number or less, most preferably from 0 to 0.1% by number.

The fine grain can be added either continuously or intermittently. The halogen composition of the fine grain supplied can be varied either continuously or intermittently to the feeding time. The fine grain emulsion has a pH of from 1 to 12 and a pX of from 0.5 to 6 and the most preferred combination can be selected from this range.

In forming the fine grain, the fine grain satisfying the above-described prescription can be formed rather with a dispersion medium capable of strong adsorption to the AgX grain. On the other hand, in growing tabular grains by feeding the fine grains, the bonding between the dispersion medium and the AgX grain is preferably weak, because the dissolution of the fine grains is accelerated to accelerate the growth of tabular grains. Accordingly, after the formation of the AgX fine grains in a dispersion medium solution, the processing is preferably conducted to reduce the complex-forming ability of the dispersion medium with $Ag^+$ per the unit weight under the same conditions by generally 10% or more, preferably from 30 to 99%, more preferably from 60 to 95%, most preferably from 80 to 95%. The processing as used herein means to add an oxidizing agent such as $H_2O_2$ to thereby oxidize the dispersion medium and/or to add the modifying agent to thereby chemically modify the amino group. For the details of the processing and the addition method of the fine grain other than those described above, Japanese Patent Application No. 6-102485 can be referred to.

Any conventionally known apparatus can be used as an apparatus for feeding the $Ag^+$ and $X^-$ at the time of nucleation, ripening and growing and an apparatus for forming the grain.

In a preferred embodiment of the apparatus, addition holes are provided in the dispersion medium solution, the (number of addition holes/one additive solution) is generally 2 or more, preferably from 4 to $10^{15}$ in a multihole addition system, the addition hole is formed of a rubber elastic membrane, the holes are open at the addition time and the holes are closed when the addition is stopped. For the details of the addition method of the fine grain and the conventional apparatuses, literatures described later, JP-A-3-21339, JP-A-1-183417, JP-A-4-34544, JP-A-4-193336, JP-A-4-330427, JP-A-3-155539, JP-A-3-200952, JP-A-3-246534, JP-A-4-283741, JP-A-4-184326 to JP-A-4-184330, JP-A-5-11377, JP-A-5-45757, JP-A-5-61134, JP-A-5-337350, JP-A-6-11779, JP-A-6-86923, JP-A-6-142478, JP-A-6-242526 and U.S. Pat. No. 5,254,454 can be referred to.

E. Preparation Step of AgX Emulsion

The normal preparation step of the AgX emulsion conventionally consists of formation of the AgX grain→water washing of the emulsion→chemical sensitization, spectral sensitization. In the present invention, in addition to the above-described preparation step, desalting of the emulsion can be carried out after chemical sensitization and/or spectral sensitization, if desired. In this case, the AgX emulsion conditions at the chemical sensitization and the AgX emulsion conditions at the spectral sensitization can be selected differently from the AgX emulsion conditions at the coating and the optimum conditions suitable for respective steps can be advantageously selected. The chemical sensitization and the spectral sensitization can be carried out simultaneously or either one can be carried out in advance of the other.

After the emulsion is prepared, the emulsion can be washed with water and desalted in a conventional manner. Examples of the desalting include: 1) Noodle washing method, 2) a method comprising adding a coagulant, coagulating the emulsion by adjusting the pH of the emulsion to the coagulation pH to sedimentate and removing the supernatant; in the case where the emulsion contains gelatin having —$NH_2$ group and/or carboxyl group (preferably —$NH_2$ group) subjected to chemical modification, the coagulation and sedimentation can be effected by adding no or a small amount of coagulant, 3) a method for removing the aqueous solution in the AgX emulsion using an ultrafilter, 4) a method comprising sedimentating the AgX grains by centrifugal sedimentation and removing the supernatant, 5) a centrifugal filtration method and 6) an electrodialysis. For the details of these methods, literatures described later, JP-B-62-27008 (the term "JP-B" as used herein means an "examined Japanese patent publication"), JP-A-62-113137, JP-A-3-200952, and *Zoho.Enshin Bunri*, edited by Misawa, Kagaku Kogyo Sha (1985) can be referred to.

In the case of the emulsion of the present invention, also preferred is a method of substituting the dispersion medium, where from 10 to 99.9% of the dispersion medium is removed by the above-described centrifugal filtration method and a new dispersion medium is added.

F. Chemical Sensitization

The AgX emulsion grain of the present invention is preferably subjected to Sx sensitization to adsorb a spectral sensitizing dye. The Sx here indicates sulfur, selenium or tellurium. The Sx sensitizer can be a conventionally known Sx sensitizer and specific examples thereof include thioureas, rhodanines, oxazolidines, polysulfides, selenoureas, phosphine selenides, selenoamides and thiosulfates. For the details, the literatures described later can be referred to.

The AgX grain in the AgX emulsion of the present invention is preferably subjected further to gold sensitization, The gold sensitizer can be any known gold sensitizer and examples thereof include chloroauric acid, potassium chloroaurate, potassium or sodium aurithiocyanate (chloroauric acid:$SCN^-$=1:1 to 1:100 by mol), bromoauric acid, iodoauric acid, gold sulfide and gold selenide. For the details, the literatures described later can be referred to.

The ratio (mol number of additive gold sensitizer/mol number of additive Sx sensitizer) is preferably from 4 to 0.2, more preferably from 2 to 0.3, most preferably from 1.5 to 0.4. The addition amount of each sensitizer to the AgX emulsion is preferably from $10^{-2}$ to $10^{-7}$ mol/mol-AgX, more preferably from $10^{-3}$ to $10^{-7}$ mol/mol-AgX and the optimum amount is preferably selected from the above range.

G. Others

The dispersion medium used at the nucleation or ripening or the dispersion medium present together at the growth may be one or more selected from conventionally known water-soluble dispersion media and among them, gelatin is preferred. With respect to the conventionally known water-soluble dispersion medium, *Research Disclosure*, Vol. 307, Item 307105 (November, 1989), Japanese Patent Application No. 6-102485, (JP-B-52-16365, *Suiyosei Kobunshi*, edited by Tadanori Misawa, Kagaku Kogyo Sha (1987), *Kobunshi Shin Zairyo, One Point* 24, edited by Kobunshi Gakkai, Kyoritsu Shuppan (1990), *Suiyosei Kobunshi no Oyo to Shijo*, edited by Nobuharu Nagatomo, CMC Sha (1984), Ward et al., *The Science and Technology of Gelatin*, Academic Press, London (1964) can be referred to. The concentration of the dispersion medium is preferably from 0.01 to 10 wt %, more preferably from 0.05 to 3 wt %.

The thus prepared tabular grain emulsion of the present invention is in the following state immediately after the completion of the growth. In the AgX emulsion comprising at least a dispersion medium and AgX grains, tabular grains having a thickness of from 0.02 to 0.3 μm, preferably from 0.03 to 0.15 μm, more preferably from 0.03 to 0.1 μm and an aspect ratio (diameter/thickness) of from 2 to 50, preferably from 3 to 30 occupy from 75 to 100%, preferably from 90 to 100%, more preferably from 97 to 100% of the total projected area of the AgX grains; the coefficient of variation in the size distribution is from 0 to 0.3, preferably from 0 to 0.2, more preferably from 0 to 0.1; and gelatin (having a relation of the number percentage of chemically modified —$NH_2$ groups to the methionine content lying in the region $a_1$, preferably $a_2$, more preferably $a_3$ of FIG. 1) occupies from 30 to 100 wt %, preferably from 60 to 100 wt %, more preferably from 90 to 100 wt % of the dispersion medium. The methionine content can refer to the description in the above item C. The coefficient of variation in the thickness distribution of the tabular grain is preferably from 0 to 0.3, more preferably from 0 to 0.2, most preferably from 0 to 0.1.

After the AgX grain is formed as described above, the AgX grain is usually subjected to water-washing and chemical sensitization. Further, photographically useful additives such as a spectral sensitizer and an antifoggant are added thereto and then the grain is coated on a support. The addition order of the chemical sensitizer, the dye for spectral sensitization and the antifoggant can be selected optimally depending upon the purpose. The dye is preferably added to adsorb uniformly causing less distribution in the adsorption covering ratio among the grains. In this case, the adsorption rate of the dye added is preferably retarded to an appropriate extent. In other words, the uniformity is more increased when the dye added is more uniformly mixed and then starts to adsorb. The activation energy necessary for the dye to adsorb to the AgX grain is an exchange-adsorption energy with the dispersion medium molecule adsorbed. The energy is mainly an activation energy on desorption of the dispersion medium molecule.

Accordingly, in order to retard the dye adsorption rate, a dispersion medium generating a greater activation energy on desorption may be used and the solution containing the dye may be added to the AgX emulsion at a lower temperature.

In this case, a new dispersion may be added during the time period between the grain formation and the addition of the dye or a new dispersion medium may be added after removing a part or all of the dispersion medium. After optimally controlling the adsorption strength of the dispersion medium by adjusting the kind of the dispersion medium, the temperature, the pH and the pAg as described above, the dye solution is momentarily added while vigorously stirring through a hollow tube type rubber elastic multihole membrane provided in the AgX emulsion. The mixing device used at this time is preferably a mixing device substantially free of the (gas/liquid) interface because the bubbling amount can be suppressed even in a vigorous mixing. More specifically, there are (1) an embodiment where a reaction vessel capable of expansion to generally 1.05 times or more, preferably from 1.1 to 6 times the original volume according to the addition amount of the solution added is used so that the ratio (volume of the gas phase part/total volume inside the reaction vessel) of the reaction vessel can be preferably from 0 to 0.3, more preferably from 0 to 0.15, most preferably 0 and (2) an embodiment where a floating lid is provided on the surface of the mixed solution to cover preferably 10% or more, more preferably from 25 to 99%, most preferably from 50 to 98% of the entire area of the surface. JP-A-6-142478 describes thereon in detail.

Preferred embodiments of the AgX emulsion of the present invention after spectral sensitization are described below.

1) In an AgX emulsion comprising at least AgX grains having adsorbed thereon a spectral sensitizing dye and a dispersion medium, tabular grains having an aspect ratio of generally from 2 to 50, preferably from 4 to 30 and a thickness of generally from 0.02 to 0.3 μm, preferably from 0.03 to 0.15 μm, more preferably from 0.03 to 0.1 μm occupy generally from 75 to 100%, preferably from 90 to 100%, more preferably from 97 to 100% of the projected area of the AgX grains, the coefficient of variation in the size distribution is generally from 0 to 0.3, preferably from 0 to 0.2, more preferably from 0 to 0.1, and the coefficient of variation in the adsorption-covering ratio of the dye is generally from 0 to 0.3, preferably from 0 to 0.2, more preferably from 0 to 0.1.

The AgX emulsion of the present invention is preferably sensitized at least by gold. In this embodiment, preferably, 2) the AgX emulsion comprising at least AgX grains sensitized by $10^{-7}$ mol/mol-AgX or more of a gold sensitizer and a dispersion medium contains tabular grains satisfying the above-described prescription at a proportion of generally from 75 to 100%, preferably from 90 to 100%, more preferably from 97 to 100% of the projected area of the AgX grains, the gold content of the tabular grain is proportional to the surface area of the tabular grain, and the coefficient of variation in the distribution in the proportional constant among grains is generally from 0 to 0.3, preferably from 0 to 0.2, more preferably from 0 to 0.1.

The AgX emulsion of the present invention is preferably sensitized at least by selenium. In this embodiment, preferably, 3) the AgX emulsion comprising AgX grains sensitized by $10^{-7}$ mol/mol-AgX or more of a selenium sensitizer and a dispersion medium contains tabular grain satisfying the above-described prescription at a proportion of generally from 75 to 100%, preferably from 90 to 100%, more preferably from 97 to 100% of the projected area of the AgX grains, the selenium content of the tabular grain is proportional to the surface area of the tabular grain, and the coefficient of variation in the distribution in the proportional constant among grains is generally from 0 to 0.3, preferably from 0 to 0.2, more preferably from 0 to 0.1.

An AgX emulsion satisfying two, preferably three of the above-described embodiments 1) to 3) is more preferred.

The chemical sensitization nucleus according to the above-described prescription can be preferably formed by the following method. Conventionally, the AgX emulsion is first raised to the chemical ripening temperature and then a chemical sensitizer is added on the liquid surface of the AgX emulsion to effect chemical ripening. In this case, the chemical sensitization reaction of the AgX grain in contact with the high concentration solution of the chemical sensitizer proceeds rapidly to cause non-uniform formation of chemical sensitization nuclei among grains. The reaction rate decreases if the temperature of the AgX emulsion is lowered, the pAg is raised and the pH is reduced. Accordingly, in the present invention, the chemical sensitizer is added to the AgX emulsion under such conditions that the chemical sensitizer added does not substantially react to provide uniform mixing condition and then the AgX emulsion is changed to come under reaction-driving conditions to advance the reaction. Specifically, the temperature is raised if it is low, the pAg is lowered if it is high and the pH is elevated if it is low.

The selenium sensitizer and the gold sensitizer are completely uniformly mixed in the AgX emulsion and therefore, the possibility of the reaction per the unit area part on all AgX grains with the chemical sensitizer is absolutely the same. As a result, the object of the present invention can be achieved.

For the details of the uniform chemical sensitization, the uniform spectral sensitization and the verification method of the uniformity other than those described above, Japanese Patent Application No. 5-324502 can be referred to.

No conventional AgX emulsion comprising a dispersion medium and AgX grains satisfies such conditions that hexagonal tabular grains each having a thickness of generally from 0.02 to 0.12 μm, preferably from 0.02 to 0.1 μm and an aspect ratio of generally from 3 to 50, preferably from 4 to 50 occupy generally from 90 to 100%, preferably from 96 to 100%, more preferably from 98 to 100% of the total projected area of the AgX grains, the coefficient of variation in the grain size distribution is generally from 0 to 0.2, preferably from 0 to 0.1 and the shape of the main plane is bound to the maximum adjacent sides ratio of generally from 1 to 1.5, preferably from 1 to 1.2, more preferably from 1 to 1.1. The emulsion satisfying. the above-described conditions can first be produced by the method of the present invention. This emulsion can be particularly preferably used.

On observing the (100) tabular grain through a transmission-type electron microscope at −100° C. or lower, a grain image shown in FIG. 2, namely, FIG. 3(*a*) may be observed in some cases. The grain seems to be a grain having two screw dislocations described in Mignot, *Journal of Crystal Growth*, Vol. 23, 207 (1974), however, if the defect image observed comprises screw dislocation lines, it should be observed as shown in FIG. 3(*b*). The grain corresponding to FIG. 3(*b*) may also be observed in some cases, but in many cases, the dislocation lines and the two vectors for the growth in different directions are not always congruent with each other. The vector of the dislocation line is in many cases at an angle of 90° or from 65° to 75° to the (100) plane at edges. Various dislocation lines observed according to the above-described manner are shown in FIG. 4.

The screw dislocation defect can also be observed according to the following method. Namely, an AgX emulsion containing the tabular grains is coated on an undercoated flat support and dried. Due to the drying, the film thickness is reduced to about 1/10 and therefore, the tabular grains are orientated in parallel to the support. Thereafter, the reagent is cooled to generally −50° C. or lower, preferably from −100° to −200° C., and cut by a microtome to provide strips having a thickness of 0.1 μm or less. The strip is cooled to −100° C. or lower and a photograph of the grain cross-section taken by a transmission-type electron microscope is observed. By observing the interference image formed with electron beams transmitted straightly through the same region and electron beams transmitted through diffraction by the lattice atoms, the lattice image can be observed. On the observation of the images of several strips, the point where the screw dislocation passes through the strip is observed. With respect to the observation method of the lattice image, Shigeo Horiuchi, *Kobunkaino Denshi Kenbikyo*, Kyoritsu Shuppan (1988) can be referred to. In this case, most electron beams passes through the sample and the sample is less charged up.

With respect to the adsorption state of the dispersion medium to the AgX grain, the ion conductivity measurement of the AgX grain may help the understanding thereof. When the ion conductivity of interstitial silver ion Agi of the AgX grains dispersed in gelatin is measured by the dielectric loss method, if the pH of the emulsion is lowered from 7 to 4 with an $HNO_3$ solution, the ion conductivity of the cubic AgBr grain increases. This is considered because the —$NH_2$ group of gelatin is converted into —$NH_3^+$ and as a result, the adsorptivity to $Ag^+$ on the grain surface is reduced. On the other hand, in the case of an octahedral AgBr grain, the above-described change in the pH brings increase in the ion conductivity. In this case, the Coulomb adsorptivity between the —$NH_3^+$ of gelatin and the $Br^-$ on the grain surface increases to elevate the adsorptivity of gelatin. This is considered because the grain surface is occupied almost by $Br^-$ and therefore, the Coulomb interaction force is a main factor of the adsorptivity. Further, it is considered that when the adsorptivity is intensified, —S— and the like in gelatin can first interact with $Ag^+$. It is also considered that the $Agi^+$ present in balance with the negative charge of $Br^-$ on the grain surface goes out of Columbic need as a result of neutralization of the negative charge to thereby reduce the concentration.

By using the resulting grain as a host grain, an epitaxial grain may be formed at edges and/or corners of the grain and used. Further, the grain is used as a core and a grain having a dislocation line in the inside may be formed. Furthermore, grains having various known grain structures can be formed using the grain as a substrate and laminating thereon an AgX layer having a halogen composition different from that of the substrate. With respect to these, literatures described below may be referred to.

A chemical sensitization nucleus is usually imparted to the resulting emulsion grain. In this case, the production site of the chemical sensitization nucleus and the number/$cm^2$ thereof are preferably controlled. With respect to these, JP-A-2-838, JP-A-2-146033, JP-A-1-201651, JP-A-3-121445, JP-A-64-74540, JP-A-4-308840, JP-A-4-343348 and Japanese Patent Application No. 3-140712 can be referred to.

Also, using the tabular grain as a core, a shallow internal latent image type emulsion may be formed and used. A core/shell type grain can also be formed. With respect to these, JP-A-59-133542, JP-A-63-151618 and U.S. Pat. Nos. 3,206,313, 3,317,322, 3,761,276, 4,269,927 and 3,267,778 can be referred to.

The AgX emulsion grain produced according to the method of the present invention can be blended and used with one or more other AgX emulsions. The blending ratio is from 1.0 to 0.01 and the optimum ratio can be selected therefrom.

There is no particular limitation on the additives which can be added to the emulsion during the time period between the grain formation and the coating and any conventionally known, photographically useful additive can be added preferably in an amount of from $10^{-8}$ to $10^{-1}$ mol/mol-AgX. Examples of the additive include an AgX solvent, a doping agent into the AgX grain (e.g., noble metal compounds of Group VIII, other metal compounds, chalcogen compounds, SCN compounds), a dispersion medium, an antifoggant, a sensitizing dye (e.g., blue sensitizing dye, green sensitizing dye, red sensitizing dye, infrared sensitizing dye, panchromatic sensitizing dye and orthochromatic sensitizing dye), a supersensitizer, a chemical sensitizer (e.g., sulfur, selenium, tellurium, gold and noble metal compounds of Group VIII, phosphorus compounds, thiocyanate compounds, a reduction sensitizer used solely or combination of two or more thereof), a fogging agent, an emulsion sedimentating agent, a surface active agent, a hardening agent, a dyestuff, a colored image forming agent, a color photographic additive, a soluble silver salt, a latent image stabilizer, a developer (e.g., hydroquinone-based compounds), a pressure desensitizing inhibitor and a matting agent.

The AgX emulsion grain of the present invention and the AgX emulsion produced according to the method of the present invention can be used in any conventionally known photographic material. Examples of the photographic material include a black-and-white silver halide photographic material [e.g., X-ray photographic material, photographic material for printing, printing paper, negative film, microfilm, direct positive photographic material, ultrafine grain plate photographic material (for LSI photomasking, shadow masking, liquid crystal masking)] and a color photographic material (e.g., negative film, printing paper, reversal film, direct positive color photographic material, silver dye bleaching photograph). Additional examples thereof include a diffusion transfer type light-sensitive material (e.g., color diffusion transfer element, silver salt diffusion transfer element), a heat developable light-sensitive material (black-and-white, color), a high density digital recording light-sensitive material and a holographic light-sensitive material.

The silver coating amount is preferably 0.01 g/$m^2$ or more. There is either no limitation on the construction of the photographic material (e.g., layer structure, molar ratio of silver/coloring material, silver amount ratio between layers), the exposure, the apparatus for development and for producing the photographic material and the emulsion-dispersion of photographic additives, and any conventionally known embodiment and technique can be used. With respect to the conventionally known photographic additives, photographic material and construction thereof, exposure and development and apparatus for producing the photographic material, the following literatures can be referred to:

*Research Disclosure*, Vol. 176, Item 17643 (December, 1978), ibid., Vol. 307, Item 307105 (November 1989), Duffin, *Photographic Emulsion Chemistry*, the Focal Press, New York (1966), E. J. Birr, *Stabilization of Photographic Silver Halide Emulsion*, the Focal Press, London (1974), T. H. James, *The Theory of Photographic Process*, 4th ed., Macmillan, New York (1977), P. Glafkides, *Chimie et Physique Photographiques*, 5th ed., *Edition de l'Usine Nouvelle*, Paris (1987), ibid., 2nd ed., Poul Montel, Paris (1957), V. L. Zelikman et al., *Making and Coating Photographic Emulsion*, the Focal Press (1964), K. R. Hollister, *Journal of Imaging Science*, Vol. 31, pp. 148–156 (1987), J. E.

Maskasky, *Journal of Imaging Science*, Vol. 30, pp. 247–254 (1986), ibid., Vol. 32, 160–177 (1988), ibid., Vol. 33, 10–13 (1989), Freezer et al., *Die Grundlagen Der Photographischen Prozesse Mit Silverhalogeniden*, Akademische Verlaggesellschaft, Frankfurt (1968), *Nikkakyo Geppo* 1984, December, pp. 18–27, *Nippon Shashin Gakkai Shi*, Vol. 49, 7–12 (1986), ibid., Vol. 52, 144–166 (1989), ibid., Vol. 52, 41–48 (1989), JP-A-58-113926 to JP-A-58-113928, JP-A-59-90841, JP-A-58-111936, JP-A-62-99751, JP-A-60-143331, JP-A-60-143332, JP-A-61-14630, JP-A-62-6251, JP-A-63-220238, JP-A-63-151618, JP-A-63-281149, JP-A-59-133542, JP-A-59-45438, JP-A-62-269958, JP-A-63-305343, JP-A-59-142539, JP-A-62-253159, JP-A-62-266538, JP-A-63-107813, JP-A-64-26839, JP-A-62-157024, JP-A-60-192036, JP-A-1-297649, JP-A-2-127635, JP-A-1-158429, JP-A-2-42, JP-A-2-24643, JP-A-1-146033, JP-A-2-838, JP-A-2-28638, JP-A-3-109539, JP-A-3-175440, JP-A-3-121443, JP-A-2-73245, JP-A-3-119347, U.S. Pat. Nos. 4,636,461, 4,942,120, 4,269,927, 4,900,652 and 4,975,354, EP 0355568A2 and JP-A-4-193336, JP-A-4-229852, JP-A-3-200952, JP-A-3-246534, JP-A-5-11377 JP-A-4-34544, JP-A-4-226449 and JP-A-5-281640.

As the emulsion of the present invention, a constituent emulsion of the photographic materials in the examples of JP-A-62-269958, JP-A-62-266538, JP-A-63-220238, JP-A-63-305343, JP-A-59-142539, JP-A-62-253159, JP-A-1-131541, JP-A-1-297649, JP-A-2-42, JP-A-1-158429, JP-A-3-226730, JP-A-4-151649, JP-A-6-27590, JP-A-6-258788, JP-A-6-273860 and EP 0508398A1 can be preferably used.

The present invention will be described below in greater detail with reference to the following examples, but the present invention should not be construed as being limited thereto.

EXAMPLE 1

Gelatin Solution 1 [containing 1.2 l of $H_2O$, 1.0 g of Gelatin 1 and 0.25 g of KBr and adjusted to have a pH of 2.0 with a 3N solution of $HNO_3$] was placed in a reaction vessel and thereto Solution Ag-1 ($AgNO_3$: 60 g/l) and Solution X-1 (containing 1 l of $H_2O$, 43.2 g of KBr and 0.8 g of Gelatin 1) were added at a temperature kept to 40° C. while stirring at a rate of 30 ml/min over 1 minute to form nuclei. After stirring for 2 minutes, 30 ml of Solution KBr-1 (KBr: 100 g/l) was added thereto and the temperature was raised to 60° C. in 10 minutes. After subjecting the mixture to the first ripening for 12 minutes, an ammonium sulfate solution [containing 4 g of $(NH_4)_2SO_4$ and 20 ml of $H_2O$] and a 1N solution of NaOH were poured therein to adjust the pH to 9.1. After the second ripening for 10 minutes, Gelatin Solution 2 [containing 25 g of Gelatin 2, 130 ml of $H_2O$ and 0.15 g of KBr] was added thereto and the pH was adjusted to 6.3 with a 3N solution of $HNO_3$. At this time, the gelatin having a phthalization ratio of 96% and a methionine content of 34 μmol/g occupied 96.1 wt % of the dispersion medium. Solution Ag-1 and Solution X-1 were added by a double jet method while keeping the pBr of 1.68. Solution Ag-1 was added in an amount of 80 ml at a rate of 6.6 ml/min. Then, Solution Ag-2 ($AgNO_3$: 200 g/l ) and Solution X-2 (146 g/l) were added by a double jet method while keeping the same pBr. Solution Ag-2 was added at an initial flow rate of 3 ml/min and a linear flow rate acceleration of 0.3 ml/min over 40 minutes. After stirring for 1 minute, 3 ml of the emulsion was sampled and a photographic image by a transmission type electron microscope (TEM image) of a replica of the produced grain was observed. The characteristic values thereof were as follows.

99% or more of the total projected area of all AgX grains (hereinafter referred to as "SA") were occupied by hexagonal tabular grains having a maximum adjacent sides ratio of from 1 to 1.2 and the average thickness was 0.05 μm, the average diameter was 2.1 μm, the average aspect ratio was 42 and the C.V. value was 0.09.

Thereafter, the temperature of the emulsion was raised to 30° C. and the pH was lowered to 3.9 with a 1N solution of $HNO_3$ to coagulate and sedimentate the emulsion. The emulsion was washed with pure water three times and a gelatin solution was added thereto. The pH was adjusted to 6.4 with a 1N solution of NaOH and the pBr was adjusted to 2.8 with a 1N solution of NaBr to disperse the emulsion again. The resulting emulsion was placed in a closed type volume variable container described in Example 1 of Japanese Patent Application No. 5-324502 and a 0.3 g/l solution of Sensitizing Dye 1 was added at 40° C. while stirring in an amount corresponding to 70% of the saturated adsorption amount. The solution was completely added within 3 seconds in the same manner as in the above-described Example through the hollow tube type elastic multihole membrane. After stirring for 15 minutes, the content was transferred to the second closed type volume variable container. While keeping the temperature of the emulsion at 45° C., a gold sensitizer (a solution of chloroauric acid:NaSCN=1:20 by mol) was added in an amount of $1.2\times10^{-5}$ mol/mol-AgX and then Chalogenide Sensitizer S×1 was added in an amount of $2\times10^{-5}$ mol/mol-AgX. Each sensitizer was added within 3 seconds through an independent hollow tube type elastic multihole membrane described in the above-described Example.

The temperature of the emulsion was raised to 60° C. to effect ripening for 20 minutes. The temperature was lowered to 40° C., an antifoggant (4-hydroxy-6-ethyl-1,3,3a,7-tetrazaindene) was added in an amount of $3\times10^{-3}$ mol/mol-Agx, a thickener and a coating aid were added and the emulsion was coated on a TAC (cellulose triacetate) base together with a protective layer and dried. This was designated as Coated Sample 1.

Here, Gelatin 1 was a deionized alkali-processed bone gelatin having a weight average molecular weight of 30,000 and a methionine content of 34 μmol/g, Gelatin 2 was a gelatin resulting from phthalization of Gelatin 1 at a phthalization ratio of 96%, and Gelatin 3 was a deionized alkali-processed non-modified bone gelating having a methionine content of 50 μmol/g.

Sensitizing Dye 1

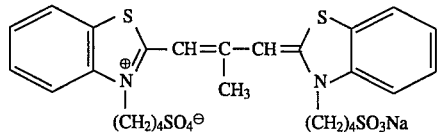

Chalcogenide Sensitizer

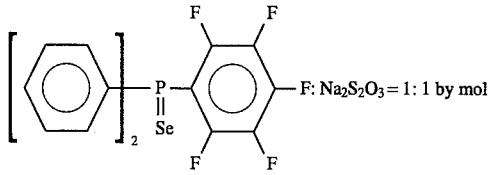

EXAMPLE 2

The same procedure as in Example 1 was conducted except for mingling 1.0 g of EPA 1 in Gelatin Solution 2. 3 ml of the emulsion was sampled and on the observation of the TEM image of a replica of the resulting grain, the following characteristic values were obtained.

99% or more of SA were occupied by hexagonal tabular grains having a maximum adjacent sides ratio of from 1 to 1.2, the average thickness was 0.09 Bm, the average diameter was 1.56 μm, the average aspect ratio was about 17 and the C.V. value was 0.075. The subsequent processings were conducted in the same manner as in Example 1 and Coated Sample 2 was obtained.

Here, EPA 1 was a copolymer of compound of formula (3)-a)-2) : compound of formula (4)-a)-4): acrylamide= 25:25:50 (wt % ratio) and had a weight average molecular weight of 33,000.

EXAMPLE 3

The same procedure as in Example 1 was conducted except for mingling 1.0 g of each of EPA 2 [a copolymer of $H_2C{=}C(CH_3){-}COO{-}(CH_2CH(CH_3)O)_{T2}H$ and acrylamide (25/75 by weight)] and 1 g of EPA 3 [a copolymer of $H_2C{=}C(CH_3){-}COO{-}(CH_2CH_2O)_{23}CH_3$ and acrylamide (25/75 by weight)] in Gelatin Solution 2. Upon the observation of the TEM image of a replica of the produced grain, the following characteristic values were obtained. 99% or more of SA were occupied by hexagonal tabular grains having the maximum adjacent sides ratio of from 1 to 1.2, the average thickness was 0.09 μm, the average diameter was 1.56 μm, the average aspect ratio was about 17 and the C.V. value was 0.07. The TEM image showing the grain structure of the resulting grain is shown in FIG. 5. The resulting coated sample was designated as Coated Sample 3.

EXAMPLE 4

The procedure until the completion of the second ripening was carried out in the same manner as in Example 1. Then, a 1N solution of HNOB was added to adjust the pH to 6.2, the temperature was lowered to 30° C., the emulsion was placed in a conical trapezoid type centrifugal separator and centrifuged and the supernatant was removed. The removal volume ratio was 93% of the original emulsion. Then, Gelatin Solution 2 was poured therein, the pH was adjusted to 6.2 to disperse the emulsion again and the emulsion was transferred to the previous container. The temperature was set to 60° C., a 10 g/l solution of EPP 1 was added as a PAO compound in an amount of 7 ml and the subsequent processes were carried out in the same manner as in Example 1. 3 ml of the emulsion was sampled and upon the observation of the TEM image of a replica of the produced grain, the following characteristic values were obtained.

99% or more of SA were occupied by hexagonal tabular grains having a maximum adjacent sides ratio of from 1 to 1.2, the average thickness was 0.11 μm, the average diameter was 1.41 μm, the average aspect ratio was about 12.8 and the C.V. value was 0.075. The same processings as in Example 1 followed and then Coated Sample 4 was produced. Here, EPP 1 was a block copolymer (molecular weight: about 3,200) of polyethylene oxide and polypropylene oxide and available under the trade name of Pluronic 31R1 (manufactured by BASF AG). This was a PAO polymer corresponding to the above-described HP2.

EXAMPLE 5

Gelatin Solution 51 [containing 1.2 l of $H_2O$, 1.7 g of gelatin and 1.2 g of KBr and adjusted to have a pH of 3.0 with a 1N solution of $HNO_3$] was placed in a reaction vessel and while keeping the temperature of 30° C., Solution Ag-51 ($AgNO_3$:100 g/l) and Solution KBr-51 (KBr: 72 g/l) were added at a rate of 50 ml/min over 1 minute to form nuclei. After stirring for 1 minute, 10 ml of Solution KBr-2 (KBr: 300 g/l) was added and the temperature was raised to 60° C. in 10 minutes. After the first ripening for 7 minutes, Gelatin Solution 3 (containing 25 g of Gelatin 3 and 135 ml of $H_2O$) was added thereto, the temperature was set to 37° C. and the pH was adjusted to 9.5 with a 1N solution of NaOH. While keeping the pH of 9.5, Phthalic Anhydride Solution 1 (containing 12 wt % of phthalic anhydride dissolved in dry acetone) was added at a constant flow rate over 15 minutes. Further, the mixture was stirred while keeping the pH of 9.5. Then the pH was adjusted to 4.0 with a 3N solution of $HNO_3$ to coagulate and sedimentate the emulsion and the supernatant was removed. Pure water was poured therein to wash the coagulated emulsion and the supernatant was removed. 1.3 l of pure water containing 1 g of EPA 1 was poured therein and the pH was adjusted to 6.4 with a NaOH solution. The temperature was raised to 60° C. and a NaBr solution was added thereto to adjust the pBr to 1.6.

Solution Ag-52 ($AgNO_3$: 120 g/l) and Solution X-52 (KBr: 90 g/l) were added by a double jet method while keeping the pBr of 1.68 over 32 minutes. The initial flow rate of Solution Ag-52 was 12 ml/min and the linear flow rate acceleration was 0.6 ml/min. After stirring for 1 minute, 3 ml of the emulsion was sampled and the TEM image of a replica of the produced grain was observed. The characteristic values thereof were as follows. 99% or more of SA were occupied by octahedral tabular grains having a maximum adjacent sides ratio of from 1 to 1.2, the average thickness was 0.09 μm, the average diameter was 1.3 μm, the average aspect ratio was about 14.4 and the C.V. value was 0.072.

Further, the emulsion was sampled and centrifuged and the supernatant was taken out. The temperature was set to 30° C., the pH of the supernatant was adjusted to 4.0 to effect coagulation and the supernatant was removed. The residue was washed with pure water three times. The coagulated product was dried and after determining the weight of gelatin, pure water and a NaOH solution were added thereto to disperse the product again to provide a 1 wt % solution. Taking a 1 wt % solution of Gelatin 3 as a comparative sample, the phthalization ratio was determined by the above-described formol titration method to find that the phthalization ratio was 95%. Accordingly, it is understood that gelatin having a phthalization ratio of 95% and a methionine content of 34 μmol/g occupied 100% of the dispersion medium at the grain growing time.

Then, the temperature of the emulsion was lowered to 30° C., the pH was adjusted to 4.0 and the emulsion was coagulated and sedimentated. The procedure (removal of the supernatant→rinsing by pouring pure water) was conducted three times and then, Gelatin Solution 3 was added. The subsequent procedure was carried out in the same manner as in Example 1 and Coated Sample 5 was obtained.

EXAMPLE 6

The same procedure as in Example 1 was conducted except for replacing Gelatin Solution 1 by Gelatin Solution 4 [containing 1.2 l of $H_2O$, 1.0 g of Gelatin 2 and 0.25 g of KBr and adjusted to have a pH of 5.0 with a $HNO_3$ solution and a NaOH solution] and Solution X-1 by Solution X-61 (containing 1 l of $H_2O$, 43.2 g of KBr and 0.8 g of Gelatin 2). In this case, 100% of the dispersion medium at the nucleation, ripening and growing time were gelatin having a phthalization ratio of 95% and a methionine content of 34 μmol/g. Upon observation of the TEM image of a replica of the produced grain, the following characteristic values were obtained. 99% or more of SA were occupied by hexagonal tabular grains having a maximum adjacent sides ratio of from 1 to 1.2, the average thickness was 0.046 μm, the average diameter was 2.19 μm, the average aspect ratio was 47.6 and the C.V. value was 0.085.

EXAMPLE 7

Coated Sample 7 was prepared in the same manner as in Example 6 except for changing water washing and re-dispersion of the emulsion as follows. After the grain formation, the temperature was set to 30° C. the emulsion was placed in a conical trapezoid type centrifugal separator and centrifuged and the supernatant was removed. The removal amount corresponded to 92% of the mother liquid amount. 2 l of pure water was poured therein to effect rinsing, then the emulsion was centrifuged and the supernatant corresponding to 92% of the mother liquid was removed. A gelatin solution containing 50 g of Gelatin 3 was added and the pH and the pBr were adjusted to 6.4 and 2.8, respectively, to re-disperse the emulsion.

Comparative Example 1

(111) Tabular grains were prepared according to Example 1 of EP 0514742A1. 100 wt % of the dispersion medium at the grain growing time had a methionine content of 0 μmol/g and a phthalization ratio of 0%.

Upon observation of the TEM image of a replica of the produced grain, the total projected area of grains in a condition that $b_2 \geqq 1.32$ occupied about 32% of SA. A coagulation sedimentating agent was added to the emulsion and the emulsion was washed with water in a usual manner. Gelatin Solution 3 was added thereto and the pH and the pBr were adjusted to 6.4 and 2.8, respectively, to re-disperse the emulsion. The subsequent processings were conducted in the same manner as in Example 1 to prepare Coated Sample 21. However, the spectral sensitizing dye and the chemical sensitizer were added in a conventional manner. The grain structure of the produced grain. is shown in FIG. 6

Each of coated samples obtained in Examples 1 to 7 and Comparative Example 1 was exposed for 0.1 second through a minus blue filter capable of transmission of lights at a wavelength of 500 nm or more and an optical wedge. Then, each sample was developed at 20° C. for 10 minutes with MAA-1 Developer [described in *Journal of Photographic Science*, Vol. 23, 249–256 (1975)]. Stopping, fixing, water-washing and drying were conducted in a usual manner and then each sample was subjected to sensitometry.

The resulting (relative values of sensitivity/granularity) are shown in Table 2. The higher the relative value, the superior the photographic performance.

The sensitivity was obtained by a reciprocal of the exposure amount giving a density of (fog+0.2). The granularity was determined by uniformly exposing each sample with a light quantity giving a density of (fog+0.2) and then developing it as described above and according to the method described in *The Theory of the Photographic Process*, Macmillan, p. 619.

EXAMPLE 8

The same procedure as in Example 7 was repeated except for replacing the phthalized gelatin used in Gelatin Solution 4 and Solution X-61 by Gelatins 81 to 86 shown in Table 2. Gelatins 81 to 89 had a methionine content and a phthalization ratio as shown in Table 3. Coated samples of the AgX emulsion prepared using Gelatins 81 to 89 were designated as Coated Samples 81 to 89, respectively.

Each coated sample was exposed for 0.1 second through the above-described minus blue filter and an optical wedge and then, developed at 20° C. for 10 minutes with MAA-1 Developer. The resulting [relative values of (sensitivity/granularity)] obtained by the sensitometry are shown in Table 3. When gelatin having the relation in region $a_1$, preferably $a_2$, more preferably $a_3$ of FIG. 1 was used, the most preferred photographic properties were provided.

TABLE 2

| | Example | | | | | | | Comparative Example |
|---|---|---|---|---|---|---|---|---|
| | 1 | 2 | 3 | 4 | 5 | 6 | 7 | 1 |
| Sensitivity/granularity | 106 | 112 | 114 | 110 | 118 | 116 | 118 | 100 |

TABLE 3

| Gelatin No. | Methionine Content (μmol/g) | Phthalization Ratio (%) | Sensitivity/Granularity |
|---|---|---|---|
| 81 | 5 | 92 | 90 |
| 82 | 17 | " | 105 |
| 83 | 32 | " | 120 |
| 84 | 70 | " | 112 |
| 85 | 5 | 50 | 103 |
| 86 | 17 | " | 114 |
| 87 | 30 | " | 112 |
| 88 | 70 | " | 104 |
| 89 | " | 0 | 100 |

EXAMPLE 9

Gelatin Solution 4 [containing 1.2 l of $H_2O$, 20 g of Gelatin 1 and 0.5 g of NaCl and adjusted to have a pH of 4.0 with a 1N solution of $HNO_3$] was placed in a reaction vessel and while keeping the temperature of 40° C. and stirring, Solution Ag-91 ($AgNO_3$: 200 g/l) and Solution X-91 (NaCl: 65 g/l) were added by a double jet method over 15 seconds at a rate of 50 ml/min. After stirring for 1 minute, Solution X-92 (containing 6 g of NaCl and 15 g of KBr in 1 l) was added over 24 seconds at a rate of 60 ml/min. After stirring for 1 minute, Solution Ag-91 and Solution X-91 were added by a double jet method over 1 minute at a rate of 50 ml/min. After the nucleation, the temperature was set to 37° C., a 1N solution of NaOH was added to adjust the pH to 9.2 and while keeping the pH of 9.3, Phthalic Anhydride Solution 1 was added over 15 minutes. The stirring was continued for further 20 minutes while keeping the pH of 9.3. The pH was adjusted to 4.0 with a 3N solution of $HNO_3$ to coagulate and sedimentate the emulsion and the supernatant was removed. 1.3 l of pure water containing 2.5 g of NaCl was poured and the pH was adjusted to 6.0 with a NaOH solution to re-disperse the emulsion. The pH was adjusted to 5.3 with a $HNO_3$ solution and the temperature was raised to 75° C. in 12 minutes. After ripening for 18 minutes, 10 ml of Solution NaCl-1 (NaCl: 100 g/l) was added and the ripening was effected for further 5 minutes. The ripening was ended here.

Solution Ag-91 was added at a rate of 7 ml/min and the silver potential was adjusted to 140 mV.

While keeping the silver potential of 140 mV, Solution Ag-91 and Solution X-91 were added by a double jet method. The initial flow rate of Solution Ag-91 was 7 ml/min, the linear flow rate acceleration was 0.05 ml/min and the total addition amount was 290 ml. Then, Solution Ag-91 and Solution X-93 (containing 23 g of KBr and 59 g of NaCl in 1 l) were added by a double jet method while keeping the silver potential of 120 mV. Solution Ag-91 was added over 7 minutes at a rate of 8 ml/min. Thereafter, Solution Ag-91 and Solution X-94 (containing 45 g of KBr and 50 g of NaCl in 1 l) were added over 7 minutes at a rate of 8 ml/min while keeping the silver potential of 120 mV. After stirring for 1 minute, the temperature was raised to 30° C. and the pH was adjusted to 4.0 with $HNO_3$ to coagulate and sedimentate the emulsion.

The emulsion was washed with pure water, a gelatin solution was added thereto and the pH and the pCl were adjusted to 6.1 and 2.2, respectively, with a NaOH solution. 3 ml of the emulsion was sampled and the TEM image of a replica of the produced grain was observed. The characteristic values were as follows. About 94% (aspect ratio≧3) of SN were occupied by (100) tabular grains having the main planes in the form of a right-angled parallelogram, the average thickness was 0.12 μm, the average diameter was 1.3 μm, the average aspect ratio was about 10.8 and the C.V value of the tabular grain was 0.25.

The emulsion temperature was set to 40° C. and a 0.3 g/l solution of Sensitizing Dye 2 was added in the above-described multihole membrane addition system over 3 seconds in an amount corresponding to 65% of the saturated adsorption amount. After stirring for 15 minutes, the emulsion was transferred to the next vessel and while keeping the emulsion temperature of 40° C., a hypo was added through the multihole membrane system in an amount of $2.5\times10^{-5}$ mol/mol-AgX and then chloroauric acid was added in an amount of $10^{-5}$ mol/mol-AgX. The temperature was raised to 50° C. the ripening was effected for 15 minutes, Antifoggant 2 was added in an amount of $3\times10^{-3}$ mol/mol-AgX and the temperature was set to 40° C. A thickener and a coating aid were added and the emulsion was coated on a TAC base together with a protective layer and dried to obtain Coated Sample 9.

Sensitizing Dye 2

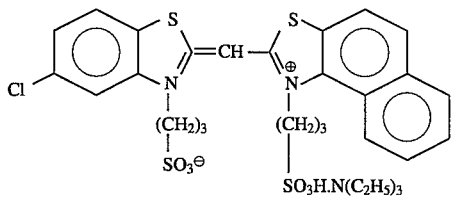

Antifoggant 2

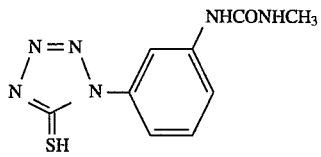

EXAMPLE 10

The same procedure as in Example 9 was repeated until the end of nucleation. Then, the emulsion was placed in a conical trapezoid type centrifugal separator and centrifuged and the supernatant was removed. The removal amount was 95% of the mother liquid amount. Thereafter, Gelatin Solution 2 was added, the pH was adjusted to 5.3 to re-disperse the emulsion and the emulsion was returned to the original reaction vessel. The dispersion medium at this time contained gelatin having a phthalization ratio of 96% and a methionine content of 34 μmol/g in a proportion of 96.1 wt %. A solution containing 2.6 g of NaCl and 20 ml of $H_2O$ was added and the temperature was raised to 75° C. in 12 minutes. After the raising of the temperature, the processings were carried out in the same manner as in Example 9 to obtain Coated Sample 10.

Upon the observation of the TEM image of a replica of the produced grain, the following characteristic values were obtained. About 94% (aspect ratio≧3) of SA were occupied by (100) tabular grains having the main planes in the form of a right-angled parallelogram, the average thickness was 0.13 μm, the average diameter was 1.25 μm, the average aspect was about 9.6 and the C.V. value of the tabular grain was 0.26.

Comparative Example 2

Coated Sample 22 was prepared in the same manner as in Example 9 except for the following steps. After the end of nucleation, an NaCl solution (containing 1.6 g of NaCl and 20 ml of $H_2O$) was added, the pH was adjusted to 5.3 and the temperature raising step to 75° C. started. The desilvering after the crystal growth was conducted in a conventional coagulation-sedimentation washing by adding a coagulation sedimentating agent. 100 wt % of the dispersion medium at the grain growing time had a phthalization ratio of 0% and a methionine content of 34 μmol/g.

Upon the observation of the TEM image of a replica of the produced grain, the following characteristic values were obtained. About 90% (aspect ratio≧3) of SA were occupied by (100) tabular grains having the main planes in the form of a right-angled parallelogram, the average thickness was 0.19 μm, the average diameter was 1.03 μm, the average aspect ratio was about 5.4 and the C.V. value of the tabular grain was 0.30.

Each of Coated Samples 9, 10 and 22 was exposed for $10^{-2}$ second through a minus blue filter and developed. As a result of sensitometry, the relative value of (sensitivity/granularity) was 112 for Sample 9, 110 for Sample 10 and 100 for Sample 22. Thus, the effect of the method of the present invention was confirmed.

When one or more layer of the thus-prepared AgX emulsion is coated on a support to produce a photographic material, the photographic material obtained shows a low fog density and excellent sensitivity and granularity, and further, the advantage that the adsorption inhibition of the additives which are effective to the other photographic properties is less since the suitable addition amount of the PAO polymer is about 20% or less as compared with that of embodiments in European Patent No. 514742A, can be obtained.

While the invention has been described in detail and with reference to specific embodiments thereof, it will be apparent to one skilled in the art that various changes and modifications can be made therein without departing from the spirit and scope thereof.

What is claimed is:

1. A method for producing silver halide grains containing tabular grains having a thickness of from 0.02 to 0.3 μm and an aspect ratio (diameter/thickness) of from 2 to 50 at a proportion of from 75 to 100% of the total projected area of silver halide grains, which comprises at least nucleation, ripening and growing steps in a dispersion medium solution consisting of water and a dispersion medium, wherein gelatin having the following characteristics (a) occupies from 30 to 100 wt % of said dispersion medium used in said growing step:

characteristics (a)

the relation between the number percentage of a chemically modified —$NH_2$ group selected from a secondary amino group, a tertiary amino group, and a deaminated product in said gelatin and the methionine content of said gelatin is in the region $a_1$ depicted in FIG. 1.

2. The method for producing silver halide grains as claimed in claim 1, wherein said dispersion medium solution comprises a polymer having a repeating unit of polyalkylene oxide and contains HPAO (represented by formula (1)-a) or (1)-b)) or PEOD (represented by any one of formulae (2)-a) to (2)-f)) having a molecular weight of from 500 to $10^6$ in an amount of 0.001 g/l or more:

HO-LPAOU-HPEOU-LPAOU-H (1)-a)

HO-HPEOU-LPAOU-HPEOU-H (1)-b)

wherein HPEOU represents $$\text{-}\left(\overset{R^0}{\overset{|}{C}}H-CH_2O\right)_m\text{-}$$

and LPAOU represents $\text{-}(R-O)_n$ wherein $R^0$ represents H or a hydrocarbon containing at least one polar group and having from 1 to 10 carbon atoms, R represents an alkylene group having from 3 to 10 carbon atoms and n and m each represents an average number of the repeating unit of 4 or greater;

LPU—HPEOU—H (2)-a)

LPU—HPEOU—LPU'(2)-b)

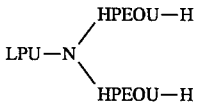
(2)-c)

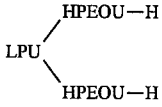
(2)-d)

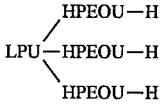
(2)-e)

HO—HPEOU—LPU—HPEOU—H (2)-f)

wherein LPU represents a lipophilic group other than an HO-HPEOU- group or an HO-LPAOU-group and represents a substituted or unsubstituted alkyl group, a substituted or unsubstituted alkenyl group, a substituted or unsubstituted aryl group, a substituted or unsubstituted heterocyclic group, a substituted or unsubstituted alkoxy group, a substituted or unsubstituted aryloxy group, a substituted or unsubstituted acyl group, a substituted or unsubstituted acylamino group, a substituted or unsubstituted alkylthio group, a substituted or unsubstituted arylthio group, a substituted or unsubstituted alkoxycarbonyl group, a substituted or unsubstituted aryloxycarbonyl group or a substituted or unsubstituted alicyclic group and HPEOU and LPAOU each has the same meaning as in formulae (1)-a) and (1)-b); and LPU' represents a hydrogen atom or an alkyl group having 1 to 20 carbon atoms.

3. The method for producing silver halide grains as claimed in claim 2, wherein $R^0$ is H.

4. The method for producing silver halide grains as claimed in claim 1, wherein said dispersion medium solution contains at least one polymer containing 1 wt % or more of a repeating unit of the monomer represented by formula (3) in an amount of 0.01 g/l or more and said polymer has a molecular weight of from 500 to $10^6$:

$$CH_2=\overset{R^1}{\overset{|}{C}}-L\text{-}\left(R^3-O\right)_n\text{-}R^2 \quad (3)$$

wherein $R^1$ represents H or a lower alkyl group having 1 to 4 carbon atoms, $R^2$ represents a monovalent substituent having 1 to 20 carbon atoms, $R^3$ represents an alkylene group having from 3 to 10 carbon atoms, L represents a divalent linking group and n represents an average number of a repeating unit of from 4 to 600.

5. The method for producing silver halide grains as claimed in claim 1, wherein said dispersion medium solution contains 0.01 g/l or more of a copolymer containing at least two kinds of monomers represented by formula (3) and formula (4) each in an amount of 1 wt % or more and said copolymer has a molecular weight of from 500 to $10^6$:

$$CH_2=\overset{R^1}{\overset{|}{C}}-L\text{-}\left(R^3-O\right)_n\text{-}R^2 \quad (3)$$

wherein $R^1$ represents H or a lower alkyl group having 1 to 4 carbon atoms, $R^2$ represents a monovalent substituent having 1 to 20 carbon atoms, $R^3$ represents an alkylene group having from 3 to 10 carbon atoms, L represents a divalent linking group and n represents an average number of a repeating unit of from 4 to 600;

$$CH_2=C(R^4)-L'-(CH_2CH_2O)_m-R^5 \quad (4)$$

wherein $R^4$ represents H or a lower alkyl group having 1 to 4 carbon atoms, $R^5$ represents a monovalent substituent having 1 to 20 carbon atoms, L' represents a divalent linking group and m represents an average number of a repeating unit of from 4 to 600.

6. The method for producing silver halide grains as claimed in claim 1, wherein said dispersion medium solution contains at least one polymer containing 1 wt % or more of a repeating unit represented by formula (5) and at least one polymer containing 1 wt % or more of the repeating unit represented by formula (6) respectively in an amount of 0.01 g/l or more and each polymer has a molecular weight of from 500 to $10^6$:

$$-(R-O)_n- \quad (5)$$

$$-(CH_2CH_2O)_m- \quad (6)$$

wherein R represents an alkylene group having from 3 to 10 carbon atoms and n and m each represents an average number of the repeating unit of 4 or greater satisfying the requirement for the molecular weight.

7. The method for producing silver halide grains as claimed in claim 6, wherein the polymer having the repeating unit represented by formula (5) is at least one polymer selected from polymers containing a vinyl polymer having a monomer represented by formula (7)-(*a*) as a constituent component and a polyurethane represented by formula (7)-(*b*) and the polymer having the repeating unit represented by formula (6) is at least one polymer selected from polymers containing a vinyl polymer having a monomer represented by formula (7)-(c) as a constituent component, a polyurethane represented by formula (7)-(d) and a substituted or unsubstituted polyethylene glycol:

$$CH_2=C(R^1)-L-(R^3-O)_n-R^2 \quad (7\text{-a})$$

$$+O-(R-O)_n]_x-+O-R^{11}-O]_y+CONH-R^{12}-NHCO]_z- \quad (7\text{-b})$$

$$CH_2=C(R^4)-L'-(CH_2CH_2O)_m-R^5 \quad (7\text{-c})$$

$$+O+CH_2CH_2O)_m]_{x'}+O-R^{13}-O]_{y'}+CONH-R^{14}-NHCO]_{z'}- \quad (7\text{-d})$$

wherein n and m each represents an average number of the repeating unit of from 4 to 600, $R^1$ and $R^4$ each represents H or a lower alkyl group having from 1 to 4 carbon atoms, $R^2$ and $R^5$ each represents H or a monovalent substituent having from 1 to 20 carbon atoms, $R^3$ represents an alkylene group having from 3 to 10 carbon atoms, L and L' each represents a divalent linking group, $R^{11}$, $R^{12}$, $R^{13}$ and $R^{14}$ each represents a divalent linking group selected from the group consisting of an alkylene group having from 1 to 20 carbon atoms, a phenylene group having from 6 to 20 carbon atoms and an aralkylene group having from 7 to 20 carbon atoms, x, y, z, x', y' and z' each represents a weight percentage of each component where x and x' each is from 1 to 70, y and y' each is from 1 to 70 and z and z' each is from 20 to 70, provided that x+y+z=100 and x'+y'+z'=100, and R represents an alkylene group having from 3 to 10 carbon atoms.

8. The method for producing silver halide grains as claimed in claim 1, wherein said tabular grains have {100} faces or {111} faces as main planes and said grain have a coefficient of variation in the diameter distribution (standard deviation/average diameter) of from 0 to 0.3.

9. A silver halide emulsion comprising at least a dispersion medium and silver halide grains, wherein tabular grains having a thickness of from 0.02 to 0.3 μm and an aspect ratio (diameter/thickness) of from 2 to 50 occupy from 75 to 100% of the total projected area of said silver halide grains, said grain have a coefficient of variation in the diameter distribution (standard deviation/average diameter) of from 0 to 0.3 and said dispersion medium contains gelatin with the relation between the number percentage of a chemically modified —$NH_2$ group selected from a secondary amino group, a tertiary amino group, and a deaminated product and the methionine content being in the region $a_1$ depicted in FIG. 1 in an amount of from 30 to 100 wt %.

* * * * *